US005156207A

United States Patent [19]

Haugen et al.

[11] Patent Number: 5,156,207

[45] Date of Patent: Oct. 20, 1992

[54] HYDRAULICALLY ACTUATED DOWNHOLE VALVE APPARATUS

[75] Inventors: David M. Haugen, Sirrea Madre, Calif.; Arnold G. Edwards, Hockley; Charles W. Kinney, Houston, both of Tex.

[73] Assignee: Halliburton Company, Duncan, Okla.

[21] Appl. No.: 700,994

[22] Filed: May 10, 1991

Related U.S. Application Data

[63] Continuation of Ser. No. 587,582, Sep. 11, 1990, abandoned, which is a continuation of Ser. No. 781,410, Sep. 27, 1985, abandoned.

[51] Int. Cl.[5] ..... E21B 34/10

[52] U.S. Cl. ..... 166/142; 166/237; 166/319; 166/321; 166/323; 166/332

[58] Field of Search ..... 166/323, 321, 319, 330, 166/332, 374, 386, 72, 237, 250, 126, 128, 142, 188, 133, 152; 251/315, 58; 137/624.19, 624.18, 624.22, 625.38

[56] References Cited

U.S. PATENT DOCUMENTS

| | | | |
|---|---|---|---|
| Re. 29,562 | 3/1978 | Wray et al. | 166/336 |
| 2,984,303 | 5/1961 | Baker | 166/126 X |
| 3,007,524 | 11/1961 | Pistole et al. | 166/72 |
| 3,703,193 | 11/1972 | Raulins | 251/315 X |
| 3,856,085 | 12/1974 | Holden et al. | 166/264 |
| 3,858,649 | 1/1975 | Wray et al. | 166/162 |
| 3,860,066 | 1/1975 | Pearce et al. | 166/72 |
| 4,058,165 | 11/1977 | Holden et al. | 166/373 X |
| 4,125,165 | 11/1978 | Helmus | 166/323 |
| 4,253,521 | 3/1981 | Savage | 166/128 X |
| 4,274,486 | 6/1981 | Fredd | 166/142 X |
| 4,444,268 | 4/1984 | Barrington | 166/373 |
| 4,448,216 | 5/1984 | Speegle et al. | 251/58 X |
| 4,448,254 | 5/1984 | Barrington | 166/373 |
| 4,467,867 | 8/1984 | Baker | 166/321 X |
| 4,508,173 | 4/1985 | Read | 251/315 X |
| 4,550,780 | 11/1985 | Mott | 166/323 |
| 4,566,478 | 1/1986 | Deaton | 166/323 |
| 4,641,707 | 2/1987 | Akkerman | 166/133 X |

*Primary Examiner*—Hoang C. Dang

*Attorney, Agent, or Firm*—C. Dean Domingue; Joseph A. Walkowski; James R. Duzan

[57] ABSTRACT

A hydraulically controlled apparatus responsive to changes in well annulus pressure is disclosed. The apparatus is run into a well bore intersecting an oil and gas reservoir with perforations communicating the oil and gas reservoir with the well bore. The apparatus has an associated packer to effectively seal off the perforations in the well bore. The apparatus contains a cylindrical housing with ports on the top end and bottom end, and an operating mandrel is disposed therein. A disengaging sleeve operably connected with the operating mandrel allows the ports contained on the lower portion of the cylindrical housing below the packer to be opened and closed selectively, thereby allowing communication of the reservoir pressure through the apparatus. The disengaging sleeve and operating mandrel are activated by either an increase or decrease in annulus pressure.

9 Claims, 17 Drawing Sheets

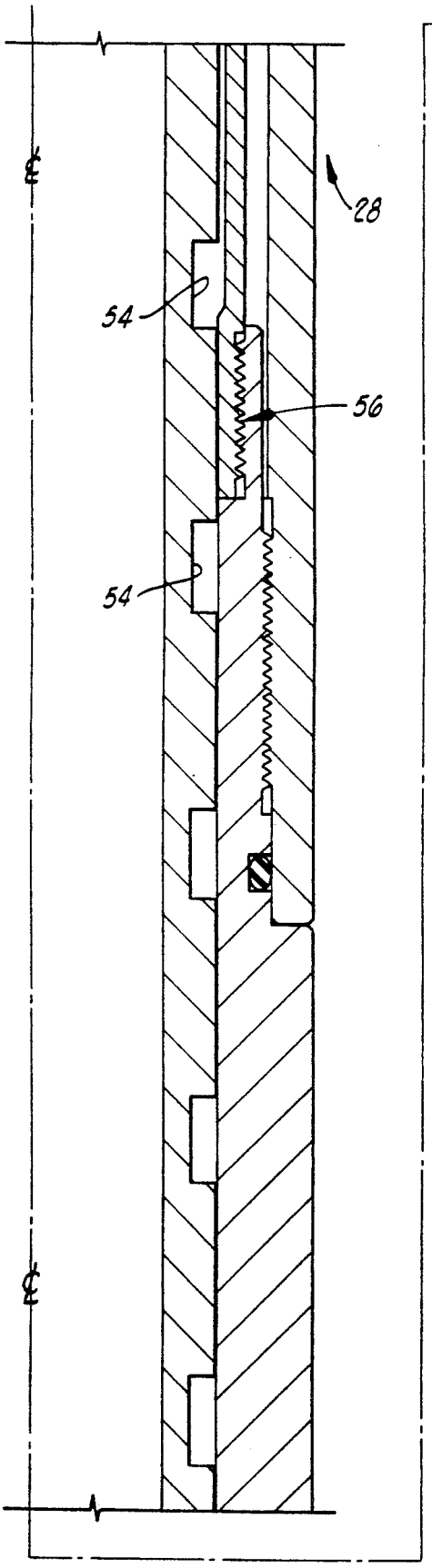
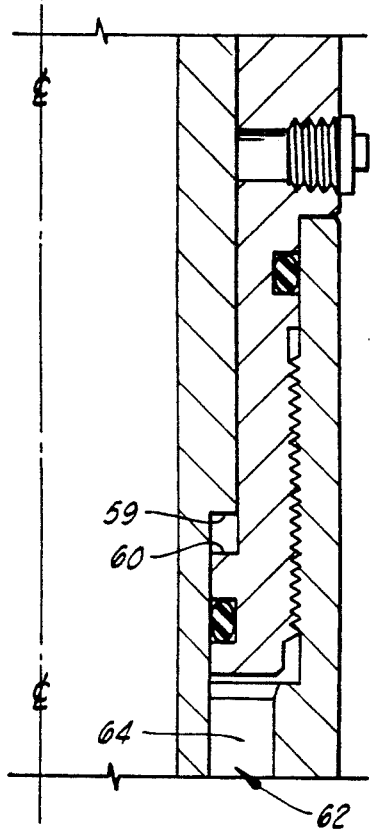
FIG. 5
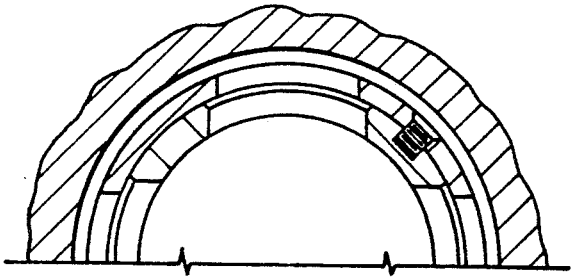
FIG. 16

HYDRAULICALLY ACTUATED DOWNHOLE VALVE APPARATUS

This application is a continuation of application Ser. No. 587,582, filed Sep. 11, 1990, which is a continuation of application Ser. No. 781,410, filed Sep. 27, 1985, both abandoned.

BACKGROUND OF THE INVENTION

After a borehole has been formed into the ground, it is often desireable to test specific isolated geological stratas in order to determine the rate of production that can be realized therefrom. This is sometime carried out during the drilling of the borehole, and at other times the testing is carried out after the borehole has been cased, cemented, and while the drilling rig is still positioned over the borehole.

Barrington 4448254 discloses a flow tester valve apparatus which is responsive to annular pressure and which utilizes a liquid spring chamber.

Barrington 4444268 discloses a flow tester valve apparatus within which there is included a chamber filled with compressable liquid for actuating a power piston.

Helms 4125165 discloses a valve apparatus for use downhole in a bore hole and employes a piston which is responsive to trapped pressure in a pressure chamber and to annular pressure for controlling a valve.

Wray 3858649 discloses oil well testing and sampling apparatus which utilizes downhole pressure and a spring means to hold a valve means closed until the hydraulic pressure opens the tool to the formation and allows testing operations to be formed.

Holden 3856085 discloses a pressure responsive formation testing method and apparatus which utilizes the valve closing and the valve opening forces which are generated in response to annular pressure.

The present invention differs from the above cited art by the provision of a valve device which is actuated by elevating borehole upper annular pressure at a minimum rate to a predetermined magnitude. The present invention avoids the dangerous practice of using high dome pressure, and enables the valve actuator means to be located above a packer while the valve means is located below the packer. A mandrel is received through the packer and connects the actuator to the valve means. The valve means includes a novel sliding valve assembly as well as a novel ball valve assembly.

The sliding valve assembly has a port associated therewith which is brought into registry with a plurality of mandrel ports, and wherein the mandrel is moved uphole by a power piston and latched into alternate positions of operation by increasing the upper annular hydrostatic pressure. The movement of a latch means and the sliding valve are coordinated such that an increase in the annular pressure unlatches the mandrel and forces the mandrel to move uphole to the next latched position, with each successive latch position effecting an opened and then a closed valve configuration.

SUMMARY OF THE INVENTION

This invention relates to a valve device; to a means for actuating a downhole tool, including a valve means; and to a combination comprised of a valve means and a valve actuator. This invention also comprehends a method of producing a well and thereafter shutting in the well, and repeating this operation several times, in order to test a downhole payzone.

One specific embodiment of this invention comprehends a tubing conveyed packer having a valve device made in accordance with the present invention attached thereto in a manner to place the valve inlet immediately adjacent the payzone and thereby flow the produced fluid directly from the payzone and uphole to the surface. This provides a true representative sample, and allows the well to be flowed any time interval, and eliminates afterflow. The well is then shut-in by increasing the upper annulus pressure, which moves the valve to the closed position. The valve can thereafter be opened and closed a number of times by pressuring the upper annulus.

The valve device of this invention includes a main housing having an axial bore formed therethrough. An elongated annular mandrel is slidably or reciprocatingly received axially within the housing. The lower marginal end of the mandrel, when moved, actuates a valve means between open and closed positions.

One embodiment of the valve means is in the form of a sliding sleeve. Ports formed in the sleeve and housing are misaligned to position the valve in the closed configuration. The mandrel when moved uphole, brings the ports into alignment and thereby positions the valve in the open position.

Another valve means is in the form of a ball element which is rotated in response to relative movement effected between the housing and the mandrel. Each 90 degrees of ball rotation moves the valve from the open to the closed position, or vice versa.

Flow from the formation fluid inlet proceeds through the valve means, up through the mandrel, and to the surface, while the bottom hole pressure, temperature, quantity, and quality of the produced fluid can be recorded and subsequently studied by the reservoir engineer.

The valve device of this invention includes a valve actuator which moves in response to the rate at which the upper annular hydrostatic pressure is increased. Increase in the hydrostatic pressure effected on the upper valve housing causes the actuator to move the valve to the alternate position. The actuator includes a hydraulically actuated piston connected to move upon a predetermined annular pressure increase, and thereafter to reset into the standby configuration when the rate of pressure increase is reduced. The piston is of annular construction and is reciprocatingly received within an annular chamber formed between the housing and the mandrel. The piston moves an unlatching mechanism associated with a latch means.

The latch means releasably anchors the mandrel to the housing, thereby preventing longitudinal movement between the mandrel and the housing. The latch means is in the form of a collet, having dogs at a free end thereof and an anchored end fixed to the housing. The mandrel has spaced grooves formed in the outer surface thereof which are engagable by the dogs. When the dogs are lifted by the unlatching mechanism, the mandrel is free to move.

The mandrel has an annular power piston affixed thereto and circumferentially extending thereabout. The mandrel piston is slidably received within a complimentary power chamber. The upper annular pressure, when increased at a predetermined rate and value, forces the mandrel to move uphole.

Flow restrictors placed in the flow passageways leading to the power piston chamber and to the piston chamber for the unlatching mechanism enable the piston movement to be sequenced, whereby the latching mechanism is unlatched; the mandrel is then moved uphole, and then the mandrel is again latched to the housing after having traveled a predetermined distance which is related to the proper sequential opening/closing of the valve means.

Accordingly a primary object of this invention is to provide a downhole valve device having an inlet in communication with a formation located below a packer wherein the valve is opened and closed a plurality of times in response to increased hydraulic pressure effected above the packer.

Another object of this invention is the provision of a method of controlling flow from a fluid producing formation located downhole in a borehole by isolating the formation with a packer, increasing the hydrostatic head above the packer, and using the increased pressure to open and thereafter close a valve a plurality of times.

A further object of the invention is to provide a method of testing a payzone of a borehole by running a packer and valve device downhole into a borehole, elevating pressure in the upper annulus to open the valve, and thereafter again elevating pressure in order to close the valve, and repeating the opening and closing of the valve a number of additional times.

A still further object of the invention is the provision of a fluid actuated device used in a tool string and placed downhole in a borehole which reciprocates a driving member a plurality of reciprocations by applying pressure in the borehole annulus.

Still another object of this invention is to provide a system which includes an improved fluid actuated valve device for use in testing a formation located downhole in a borehole by the provision of a tubing conveyed valve device having an inlet placed adjacent a payzone wherein increased hydrostatic pressure at the valve device moves the valve to the opened position, and thereafter further increase in the hydrostatic pressure moves the valve to the closed position, with the opening and closing of the valve being selectively repeated a number of times.

Another object of this invention is the provision of novel apparatus for practicing a method of controlling flow from the payzone of a well which enables the formation fluid to flow directly into a valve means and uphole to the surface of the ground, for the flow to be discontinued for any time interval, and thereafter be resumed for any time interval; and wherein the upper annular hydrostatic pressure controls the valve position, thereby enabling the reservoir Engineer to study the behavior of the drawdown and the subsequent build-up of the reservoir pressure.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

BRIEF DESCRIPTION OF THE DRAWINGS

FIGS. 3–12 are a series of broken, longitudinal, part cross-sectional views of one embodiment of the present invention;

FIG. 16 is a cross-sectional view taken along line 16—16 of FIG. 5;

DETAILED DESCRIPTION OF THE PREFERRED EMBODIMENTS

Throughout this disclosure, like or similar numerals will refer to like or similar elements whenever it is logical to do so.

Figure 1:
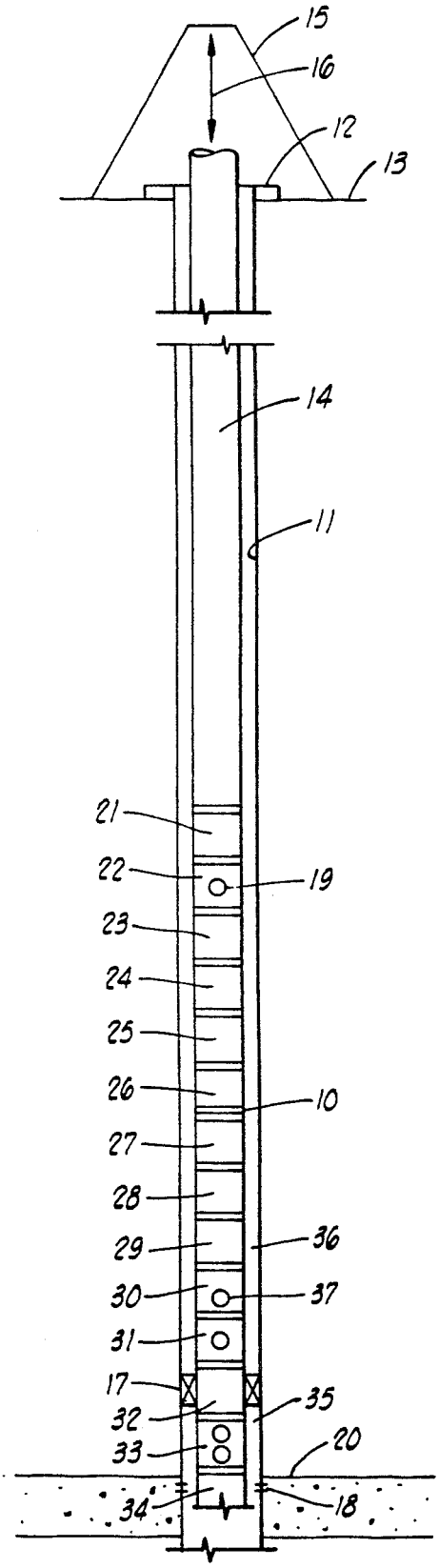
FIG. 1 is a part diagrammatical, part schematical, part cross-sectional view of a borehole formed into the ground and having apparatus made in accordance with the present invention illustrated therewith.

FIG. 1 diagrammatically sets forth a method for testing a well which can be carried out in accordance with the present invention. Apparatus 10 represents a valve device made in accordance with the present invention. The valve device is supported downhole in a borehole 11. The borehole terminates at a drilling rig floor or wellhead 12 located at ground level 13. A fluid conductor 14, preferably a tubing string, extends from the valve device 10 uphole into supported relationship with respect to a derrick 15. The derrick includes means 16 associated therewith for manipulating the tubing string 14.

The valve device 10 has a packer means 17 by which a medial portion thereof is received in sealed relationship respective to the interior sidewall of the borehole. The borehole wall below the packer 17 can be open hole, or it can be perforated as indicated by the numeral 18. The borehole 11 extends through various geological oil bearing stratas or formations 20, from which formation fluid flows into the bottom of the bore. The packer 17 belongs to the prior art and can take on any number of different forms.

The valve device 10 includes an upper end 21 having a conventional threaded sub by which the valve device can be threadedly attached to various configurations of tubing 14. The tool 10 in FIG. 1 is referred to as a multiplicity of sections for purposes of discussion. Section 22 contains a reciprocating piston and oil reservoir for effecting the upper borehole pressure measured at port 19 onto a power section of the apparatus, as will be more fully disclosed later on.

Section 23 contains latch release and spring return chamber which underlies a port 19. Section 24 is an oil reservoir which is located uphole of section 25 which contains a metering piston for an unlatching mechanism found in section 27. A mandrel latch sub is housed in section 28 and may be located above a power piston assembly section 29. An annular oil reservoir in section 30 includes a metering jet assembly. Section 31 is located adjacent to the before mentioned packer 17 and provides an optional circulation port by which the formation commodity can be reverse circulated out of the tubing. Packer 17 is connected to sub 32 of the tool, while valve sub 33 forms the lower end of the tool.

The lower end of the tool can be blocked off by a bull plug or the like, or alternatively, guns, recorders, sensors, logging devices, and the like, can be attached to the lower terminal end of the tool and extended further downhole in the borehole, for purposes which will be appreciated by those skilled in the art.

The packer 17 divides the borehole 11 into lower ar nular area 35 and upper annular area 36. Power piston hydrostatic port 37 communicates with the upper annulus 36.

In the preferred embodiment of the invention set forth in FIGS. 3–10 of the drawings, a mandrel 38 of annular construction forms the innermost wall surface of the valve device. The mandrel 38 has an upper terminal end 39, and forms an axial passageway along the longitudinal axial centerline of the valve device. A housing 41 forms the outermost surface of the valve device. Annular fluid chamber 42 is formed between the mandrel and the housing and reciprocatingly receives a free piston 43 therewithin. The free piston includes opposed faces, one of which is subjected to the hydrostatic pressure effected at port 19, and the other of which is subjected to the hydrostatic pressure of a compressible liquid contained within oil reservoir 42. Spring return 44 drives this piston 43 uphole.

The term "compressible liquid" is intended to mean a liquid, such as silicon oil, which is more compressible than another liquid, such as water. In any event any liquid can be used in the isolated oil reservoirs. The use of the silicon oil is preferred because the reservoir volume can be advantageously reduced.

Figure 3:
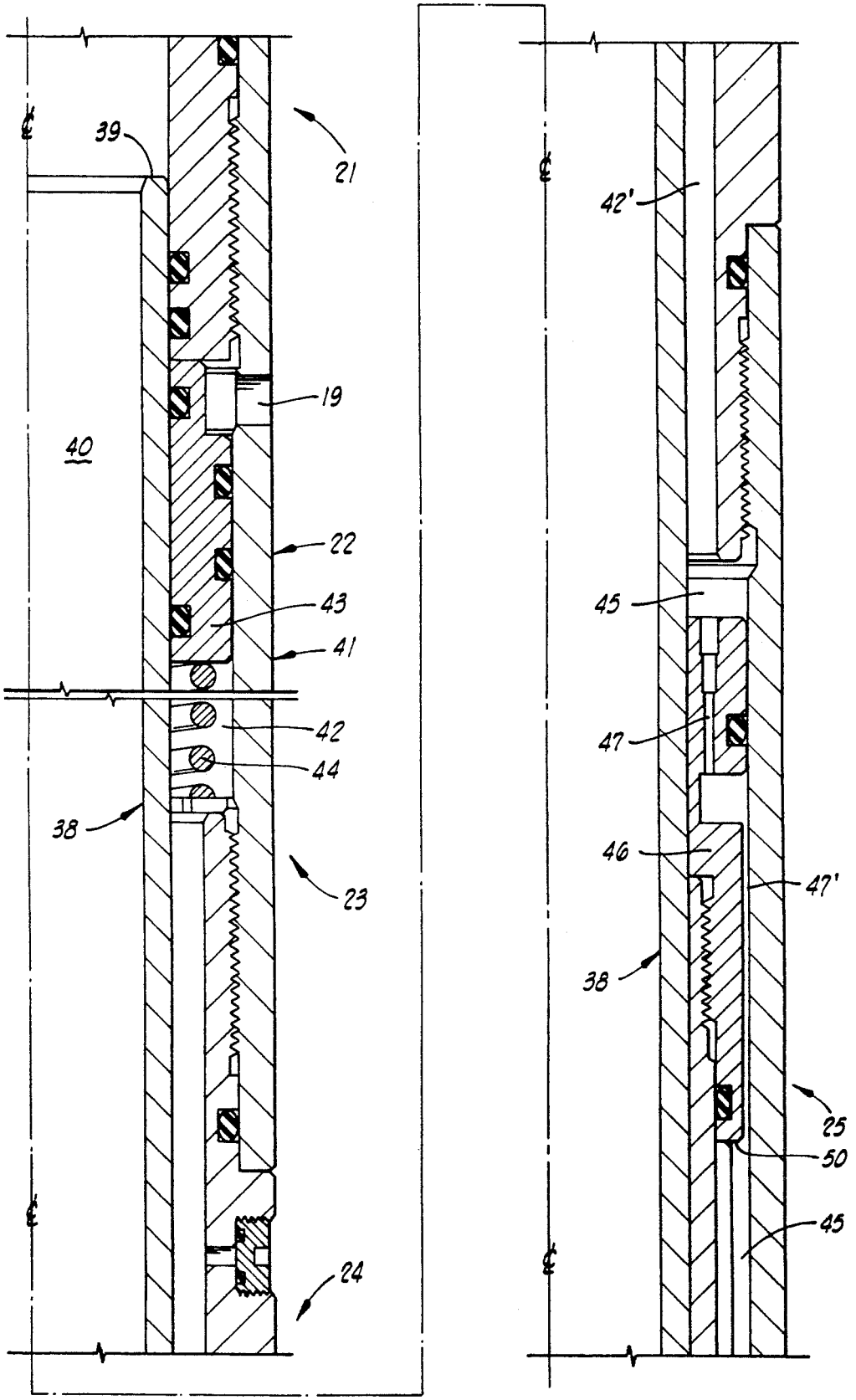
Figure 4:
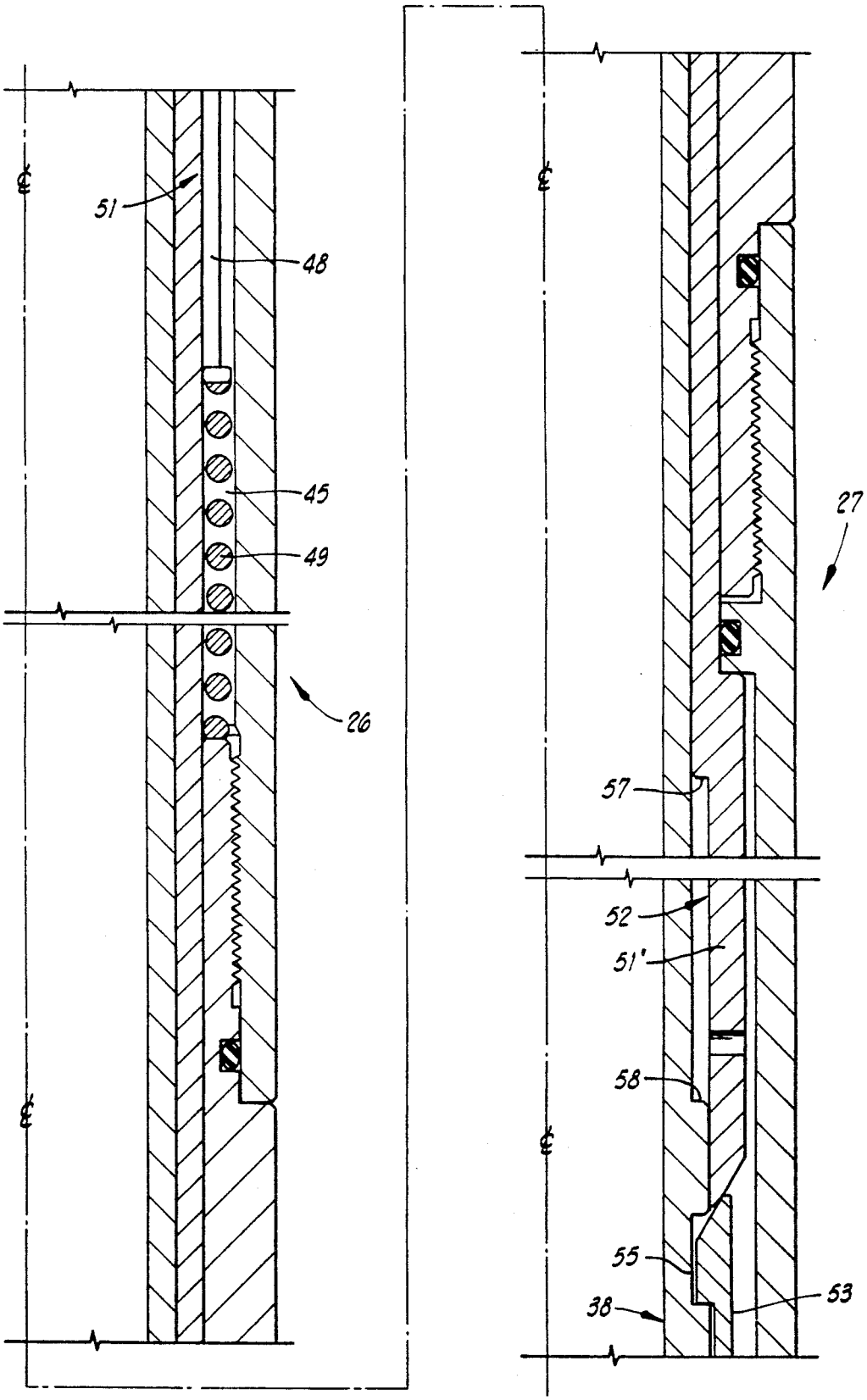

In FIGS. 3 and 4, the oil reservoir continues through passageway 42' into a released piston chamber 45. A release piston 46 is reciprocatingly received in sealed relationship within chamber 45, and includes metered passageways 47 having a Lee Check Valve (TM) therein which communicate the opposed annular piston faces by means of the illustrated small annular flow passageway 47'. The Check valve permits uphole fluid flow and restricts downhole flow therethrough. Accordingly, piston 46 includes a metered passageway 47 and 47' formed therethrough. A spring extention sleeve 48 transfers the force of a spring 49 onto shoulder 50 of piston 46, thereby resiliently biasing piston 46 uphole. A release arm 51, which can be in the form of a sleeve, or alternatively, a plurality of arms is radially spaced from the axis of the tool.

As illustrated in FIGS. 4 and 5, the before mentioned unlatching mechanism 27 and mandrel latch mechanism 28 are located within latch chamber 52. Chamber 52 is isolated from chamber 45 by the illustrated seal means. Latch release arm 51 is directly connected to latch release piston 46 and reciprocates therewith. The lower marginal end 51' of the latch release arm is provided with the illustrated dog-leg, and the lower terminal end thereof is beveled and wedgedly received under a complimentary upper marginal end of a latch means 53. A plurality of spaced grooves or detents 54 are formed in the outer wall surface of mandrel 38. The upper marginal end of the latch 53 is in the form of a dog 55 made into a configuration to be received within any one of the grooves or detents 54 and thereby rigidly lock the mandrel to latch means 53 and to the main housing at anchored end 56. The latch means 53 is comprised of a plurality of elongated metallic resilient members which can be sprung from the illustrated normal latched position, radially away from the mandrel detent, thereby releasing dogs 55 from the detent 54 when the arm 51' is wedgedly forced below dog 55, and lifts the dogs into the retracted position. Apparatus such as illustrated at 51', 55, 53 is often referred to as a "collet". The detents 54 are annular grooves formed within the annular mandrel 38, while the dogs 55 are spaced, resilient, metallic members that normally are biased into the illustrated latched position as set forth in FIGS. 4 and 5, and which can be urged into a retracted configuration in order to release the dogs from the detents. The detents 54 are aligned concentrically respective to the longitudinal central axis of the tool and can be any number considered desirable by those skilled in the art. The detents 54 are placed on centers which correspond to one half the spacing of the adjacent inlet ports associated with the sleeve of the valve sub 33, as will be more fully explained later on in this disclosure.

Shoulder 57, formed on the release arm 51', abuttingly engages shoulder 58 formed on the mandrel when the mandrel has been cycled to its uppermost position respective to the main outer housing. Shoulder 59, formed on the mandrel, abuttingly engages shoulder 60 formed on the housing when the mandrel has been cycled to its lowermost position respective to the housing. Fill plug 61 provides a means by which a compressible liquid can be introduced into the annular working space formed between the mandrel and the main housing, so that all of the compressible fluid can be evacuated therefrom by utilizing prior art expedients.

In FIGS. 5 and 6, a power chamber 62 of annular construction reciprocatingly receives a power piston 63 in sealed relationship therewithin. The power piston is suitablely sealed to the sidewalls of the annular power chamber 62 by the illustrated seal means. The power piston 63 divides the power chamber into a compressible fluid chamber 64, as for example air at atmospheric pressure, and a clean liquid chamber 65, as for example oil. The power piston 63 is affixed to the mandrel 38, and a pressure differential effected across the opposed faces of piston 63 moves the mandrel respective to the main housing.

At least one drilled passageway 66 extends from chamber 65, through a metering orifice 67, and into an oil reservoir 68. Piston 69 is reciprocatingly received within the annular oil reservoir 68 and has opposed faces, one of which is subjected to the oil contained within reservoir 68, and the other is subjected to downhole hydrostatic pressure effected at port 37. The piston 69 abuttingly engages an annular shoulder 70 formed on the main housing.

Where deemed desireable, the mandrel can be made into different lengths to facilitate handling and assembly thereof, as noted by the threaded connection at numeral 71. Moreover a sealed circulation port can be formed at 71' which extends through the sidewalls of the housing and mandrel, with the ports being sealed in a manner similar to the ports of the sliding valve assembly, as will be more fully appreciated later on in this disclosure.

Figure 8:
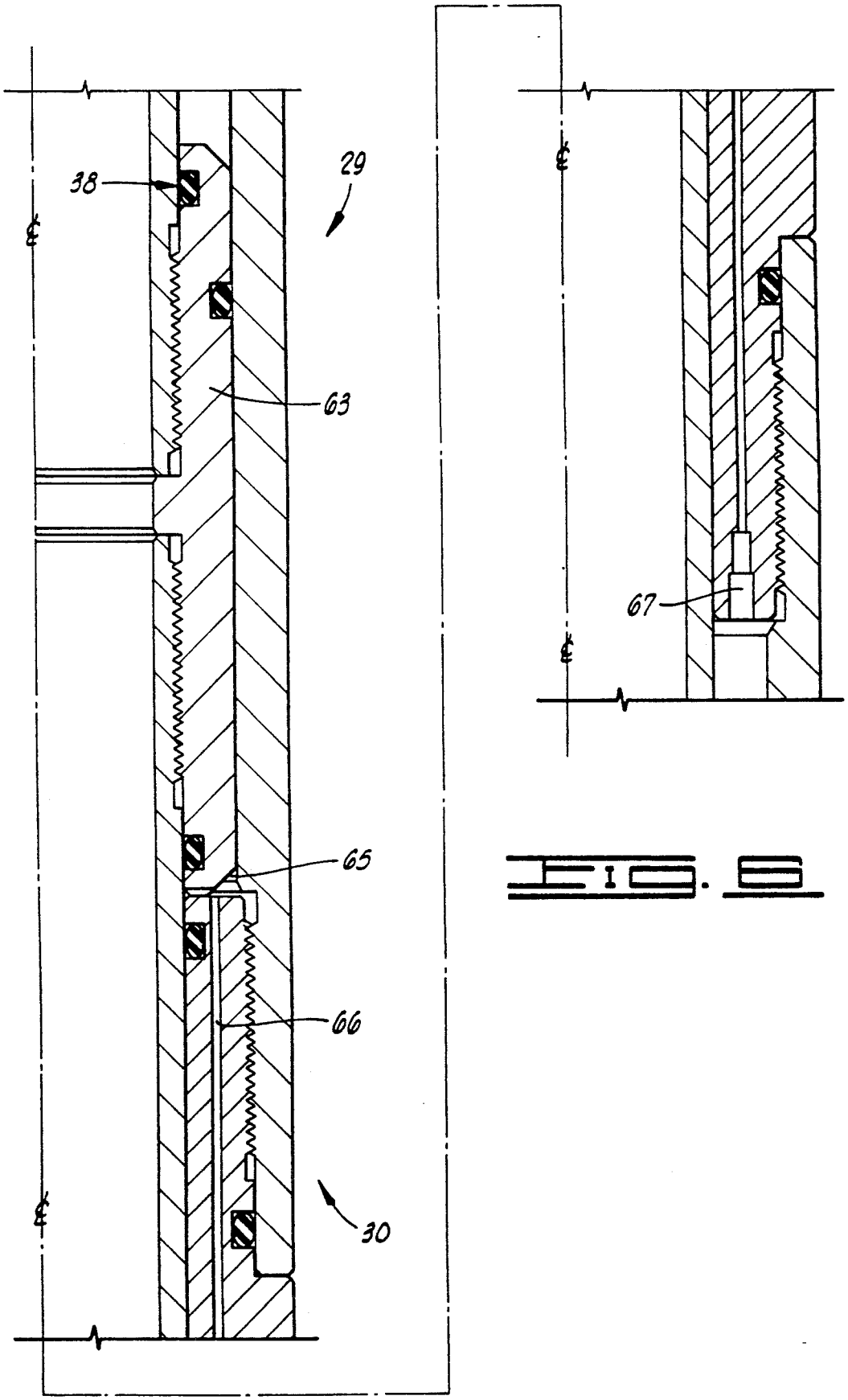
Figure 7:
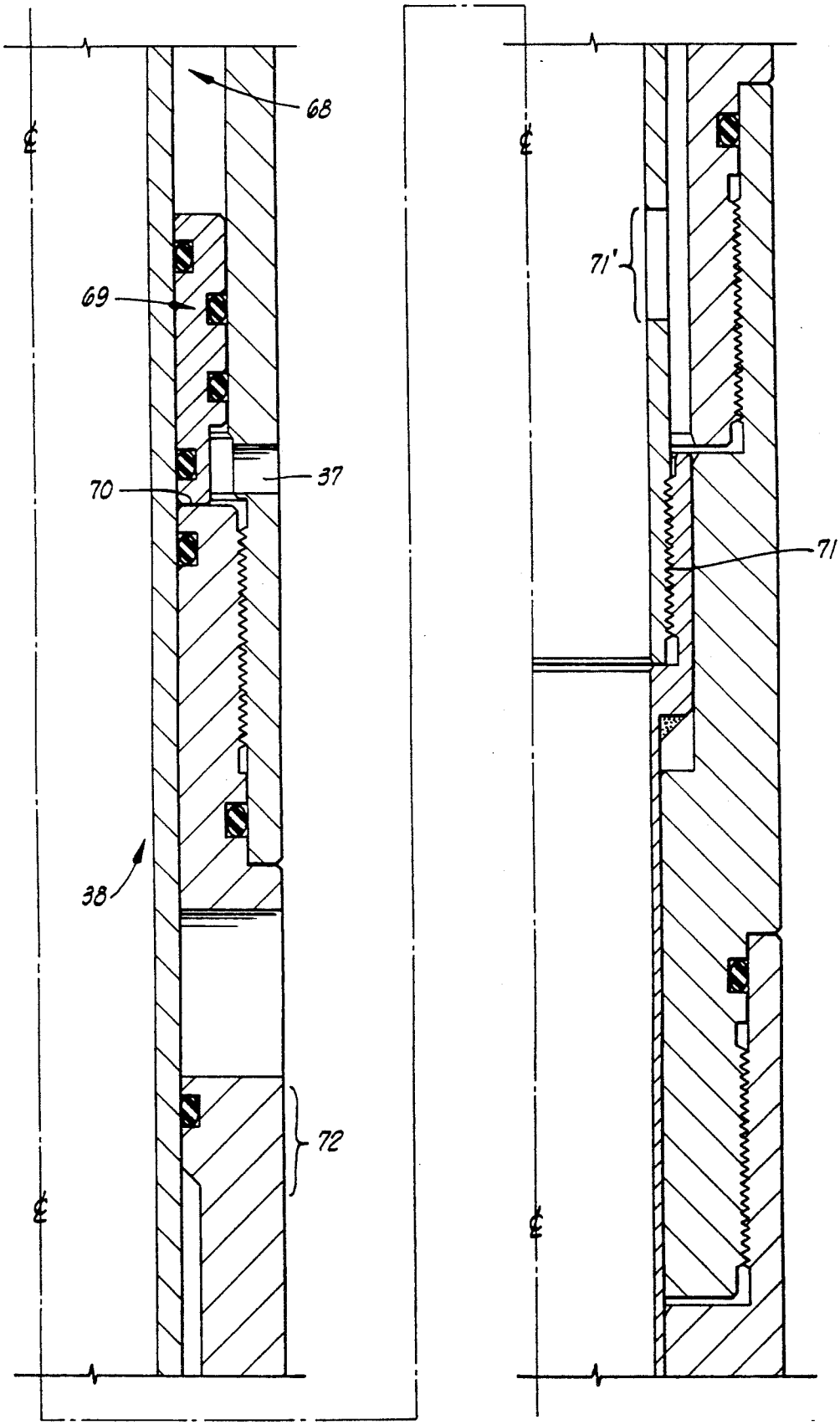
Figure 8:
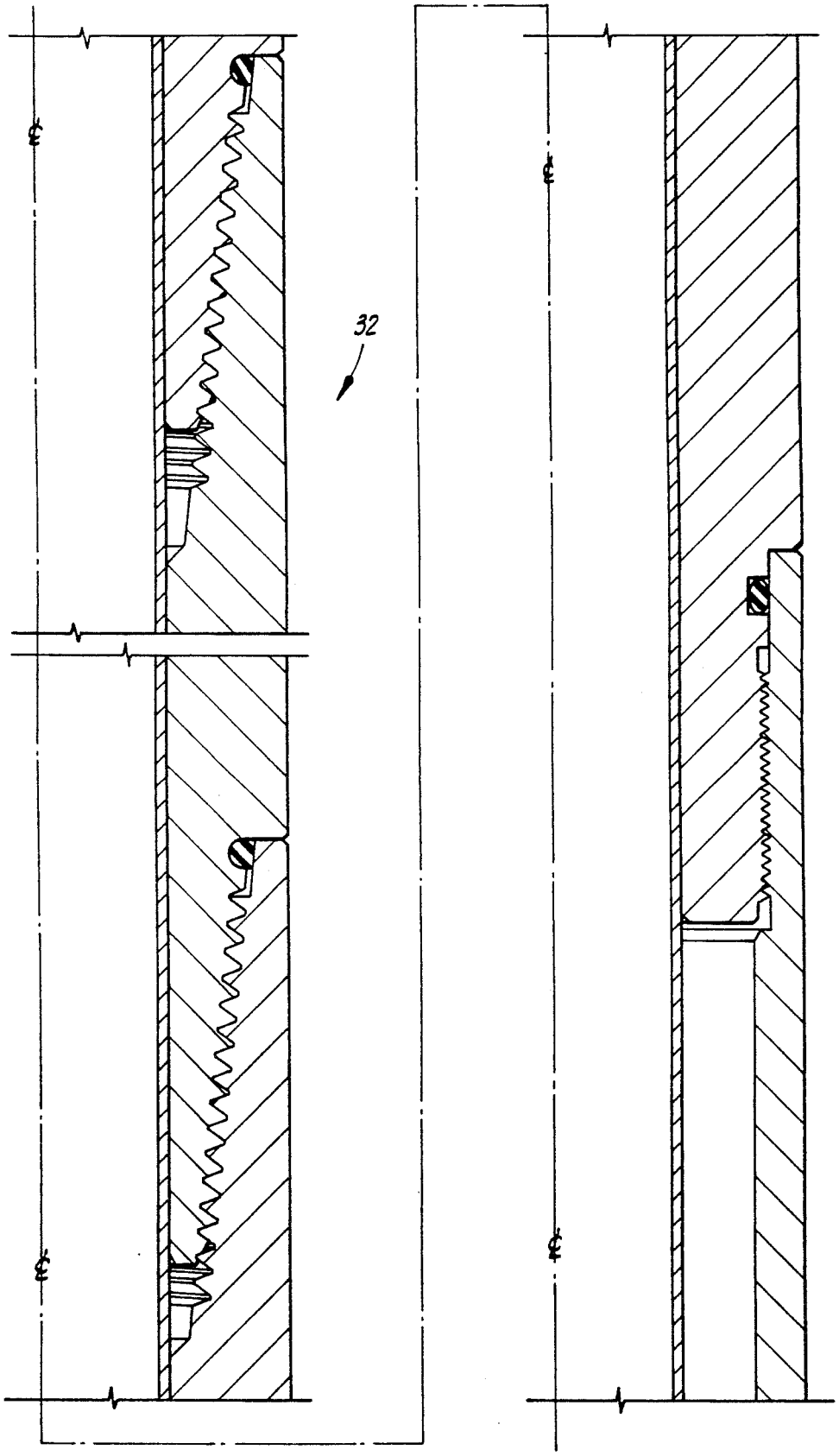

In FIG. 8, the packer sub 32 is provided with a prior art packer device which can take on any number of different forms so long as the outer surface of the housing is sealed respective to the inside wall of the borehole so that formation fluid flow must occur only through the central flow passageway of the valve device 10.

Figure 9:
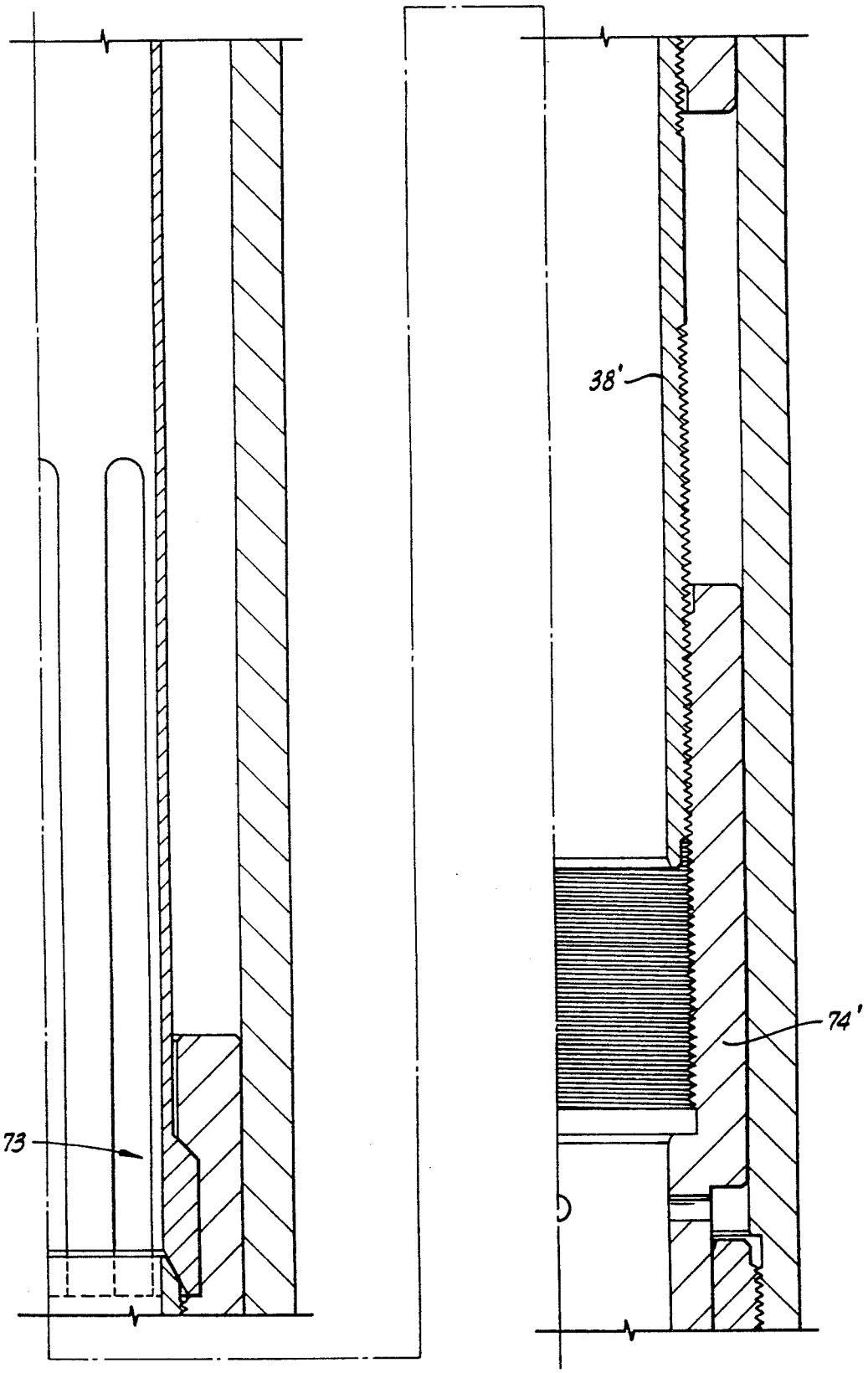
Figure 10:
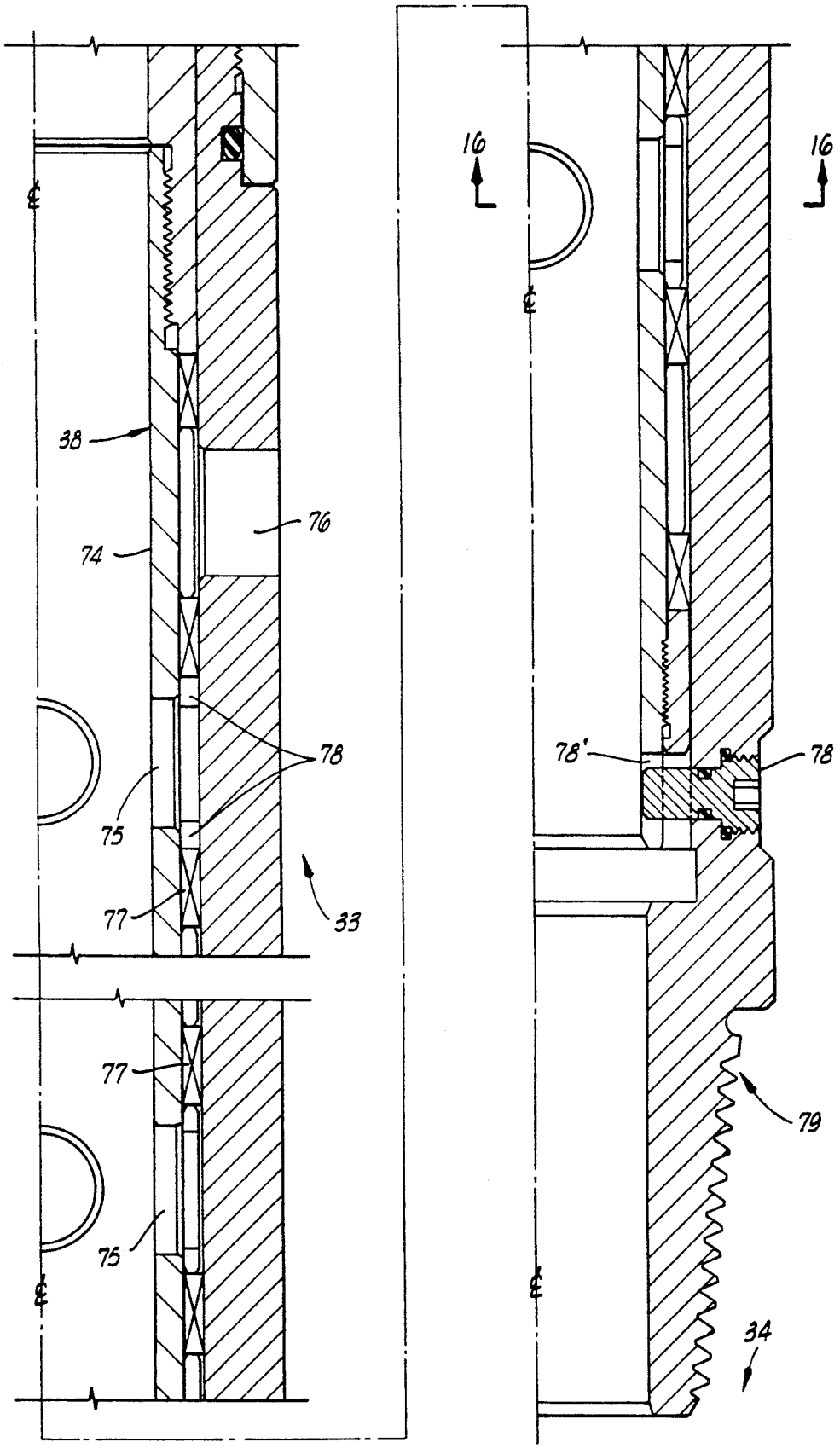

In FIGS. 8 and 9 numeral 73 broadly indicates a connector and stabilizer by which the sliding sleeve of the valve section 33 can be separated to facilitate handling and assembly.

Guide 74' forms a connector between the mandrel 38' and a sliding valve element 74. The sliding valve element 74 is an extention of and forms part of the mandrel. The sliding valve element 74 includes a plurality of ports 75 aligned in spaced relationship respective to one another and along a line arranged in spaced parallel relationship respective to the longitudinal central axis of the valve device. The ports 75 can be of any number and are spaced apart on centers a distance which enables misalignment of the ports to preclude flow of fluid therethrough and which can be brought into registry with an inlet port 76 formed through the sidewall of housing. Annular seal means 77 are affixed to the sliding sleeve valve element 74, and disposed within the annulus formed between the mandrel and the housing, and direct the flow of fluid only through ports 75, 76 when the ports are brought into registry with one another. The spacing between ports 75 is exactly twice the spacing between the detents formed in the mandrel.

Guide pin 78 is received within open slot 78' and maintains the mandrel aligned with the housing prior to actuation. Where deemed desireable, slot 78' can be elongated so that the pin always remains slidably captured within the slot, thereby preventing relative rotation between the mandrel and housing, should the valve device be subjected to unusual vibratory motion. The lower terminal end 79 of the valve device can terminate in a bull plug or other closure member. Alternatively, additional apparatus can be suspended at the illustrated pin located at lower terminal end 79; as for example logging devices, perforating guns, jars, and the like.

An important feature of the present invention is the unobstructed central passageway that extends longitudinally down through the valve device and thereby enables wireline equipment to be passed therethrough.

It is considered novel to fabricate an actuator comprised of the upper marginal end of the valve device by substituting other valve devices for the lower valve section commencing at the packer section 32.

Figure 11:
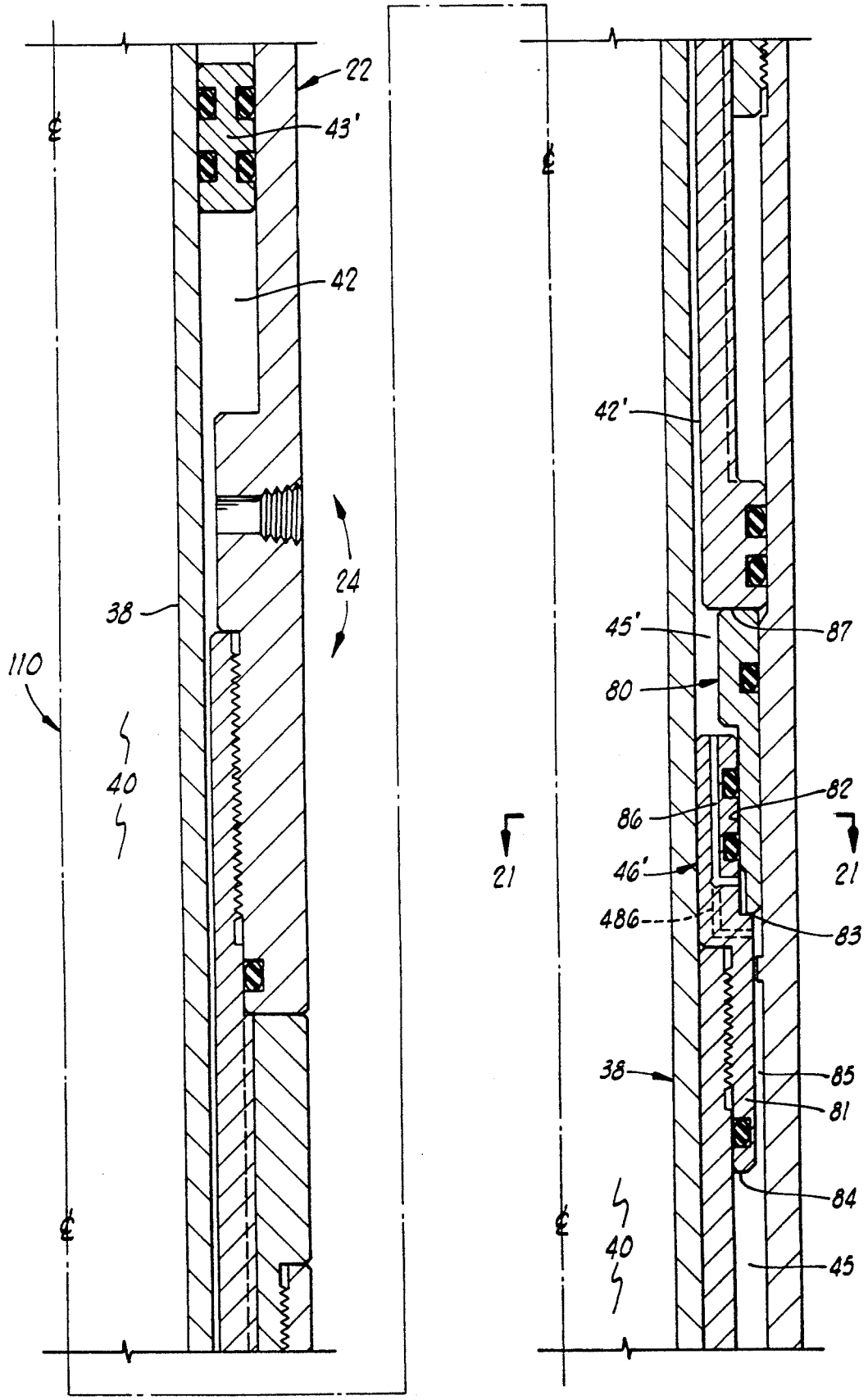
Figure 12:
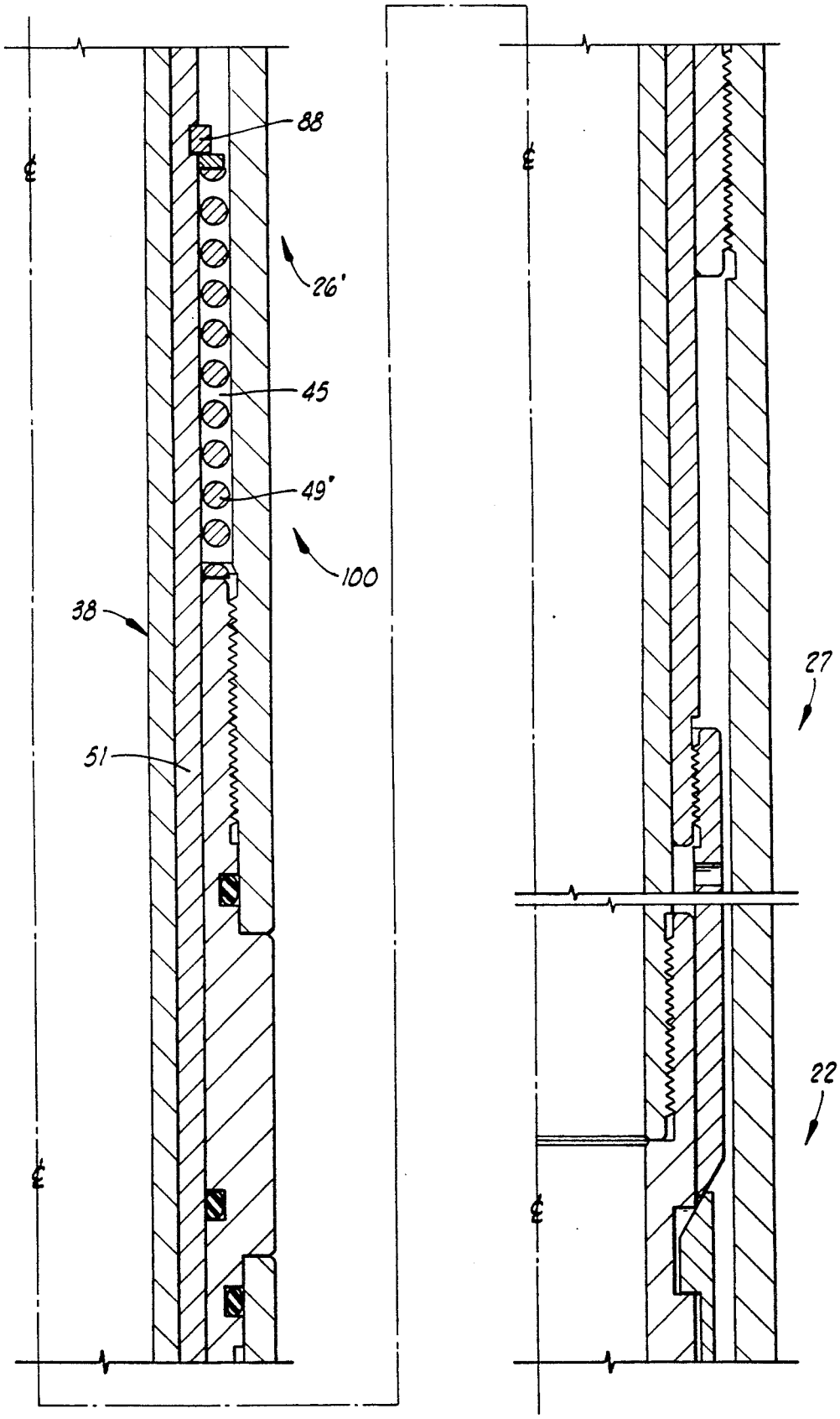

In FIGS. 11-12, there is disclosed a second embodiment comprised of the upper marginal end of the valve device. As seen illustrated in FIG. 11, piston 43' is free to reciprocate within chamber 42 and thereby divides the chamber into an upper hydrostatic pressure chamber and a lower oil filled chamber. The oil is referred to herein as a compressible liquid. Oil from chamber 42 is free to flow into chamber 45', and along the annular passageway 42'. In the alternate embodiment of FIG. 11, the novel metering release piston 46' is sealingly received in a reciprocating manner within chamber 45', and provides the force by which the latching mechanism is unlatched when piston 46' is forced to move downhole.

A marginal length of the piston includes an upper member 80 and another marginal length includes a lower member 81 which cooperate with one another, and which have adjacent marginal ends slideably received in overlapping relationship respective to one another. The slideable coating surfaces of the piston are illustrated by the numeral 82, with the illustrated seal means being interposed between the sliding surfaces. A metal to metal lip seal of annular construction is formed as indicated by numeral 83, with the resultant coacting structure functioning as a valve element and valve seat. Accordingly, when piston member 80 and piston member 81 are moved apart, the metal to metal seal at 83 is parted, and fluid is free to flow to chamber 45' from piston end 84 of member 81, about the piston at 85, through the lip seal at 83, through the passageway 86 formed in the upper marginal end of the annular piston member 81, and into the chamber 45' at the upper end of the member 80.

The piston member 81 includes passageway 486 within which a Lee Valve is mounted for allowing flow from the uphole side, through the member 81, and into the downside chamber at a location downhole of the lip seal 83. The upper terminal end of the piston assembly 46' is abuttingly engaged by a shoulder at 87 formed on structure affixed to the outer housing.

Compression spring 49' is caged within chamber 45 and urges snap ring 88 uphole. The snap ring 88 is received within a circumferentially extending groove of the release sleeve 51, and thereby urges the piston assembly 46' to move into abutting engagement with shoulder 87 of the housing.

The release mechanism 27, 28 and the latch means associated therewith are similar to the first embodiment of the invention.

FIG. 11 also discloses a lost motion coupling, or slidable sealed coupling 387 which enables the tool to telescope together until the confronting faces A and B abut one another. This provides a means for running in the tool, as will be more fully described hereinafter.

Figure 13:
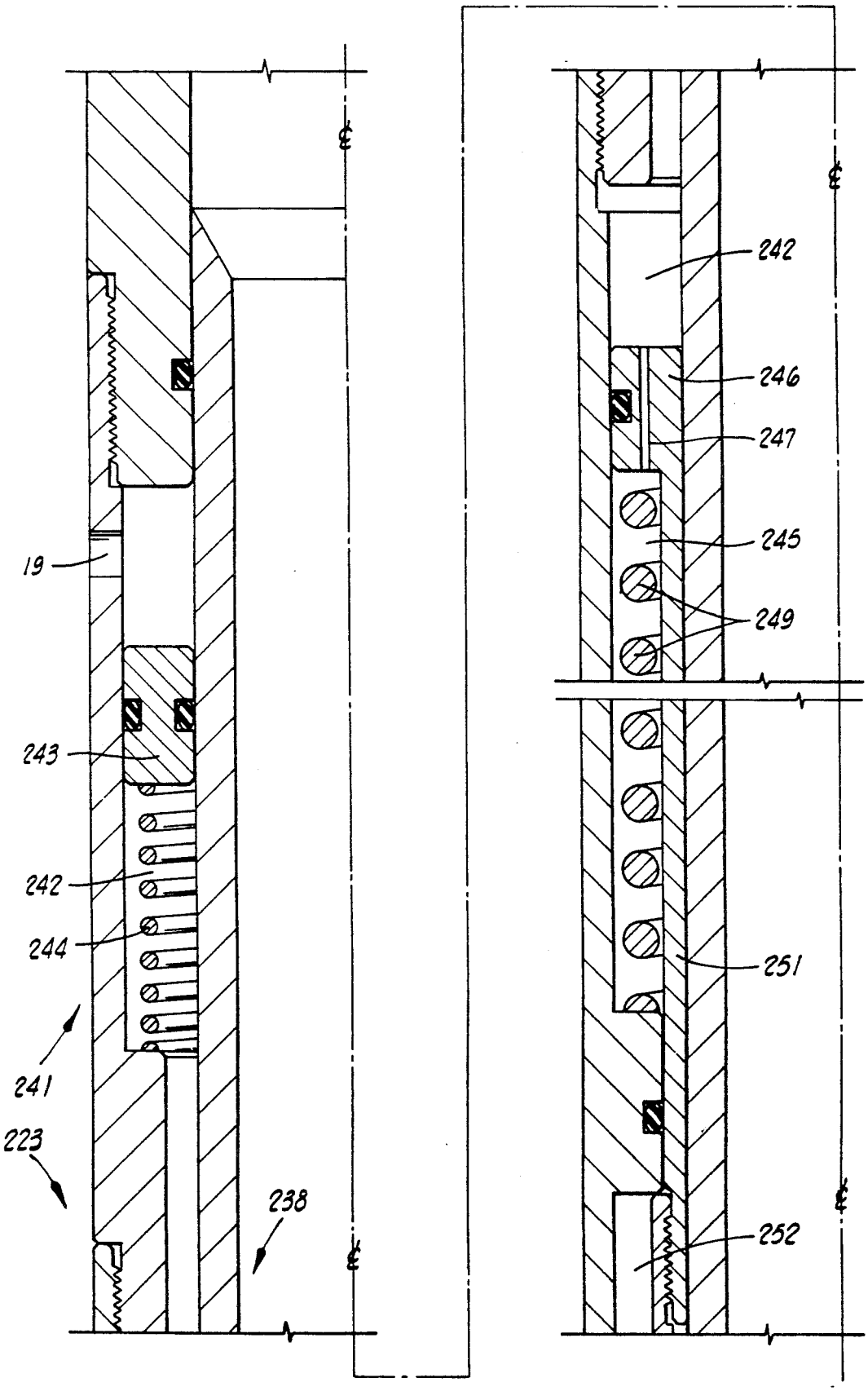
FIGS. 13–15 are a series of broken, longitudinal, part cross-sectional views of another embodiment of the present invention.

In the embodiment of the invention disclosed in FIGS. 13-18, and in particular FIG. 13, the upper marginal end of the valve device is provided with the before mentioned inlet port 19 which is arranged to receive fluid at the upper borehole pressure found immediately above packer 17. Free piston 243 is reciprocatingly received within chamber 242, and divides the chamber into a well fluid part separated from an oil containing part. The chamber 242 contains the illustrated compressed spring 244 which is abuttingly received between the confronting faces of piston 243 and the illustrated shoulder of housing 241. The chamber 242 continues downhole and provides an annular portion within which release piston 246 is reciprocatingly received. Release piston 246 has a passageway 247 formed therethrough and connects chamber part 245 with the chamber part 242.

Compression spring 249 is compressed between the illustrated confronting faces of piston 246 and the annular shoulder formed within the main housing. Actuator sleeve 251 is affixed to piston 246 and extends downhole in fixed relationship respective to release mechanism 251'. The sleeve 251 includes a wedge shaped annular face made complimentary respective to the coacting confronting face of dog 255. The dog 255 includes the illustrated inwardly directed protrusion which is received within one of the spaced detents or grooves 254. The detents 254 are spaced from one another in accordance with the vertical spacing of pins 104, 104' seen illustrated downhole of the release mechanism. The collet assembly 253, 255 has a fixed end 256 suitably connected to the housing at the anchored end thereof. Interface 89 formed between mandrel 38 and the housing is suitablely sealed as seen illustrated in FIG. 14. Interface 90 formed between fixed members is threaded at 256 and receives the illustrated seal.

Isolated annular chamber 91 is sealed at 89 and 92 and therefore isolates the valve seat 101 and valve element 95 from the remainer of the annulus. The arrows indicated by numerals 93 and 94 indicate the relative movement effected between the mandrel and the main housing when the mandrel is forced uphole by the action of the power piston.

The ball valve element 95 is pivotably mounted at 96 to a mounting frame 97. The mounting frame includes two spaced mount members having a streamlined free leading end 98 opposed to a fixed end 99. The fixed end 99 is ridigly affixed to the mandrel 238'. Seal faces 100, 101 are formed between members 238 and 238' of the mandrel. Hence the mandrel parts 238, 238' are separable and include the ball valve 95 interposed between the confronting seats or faces 100, 101.

Figure 14:
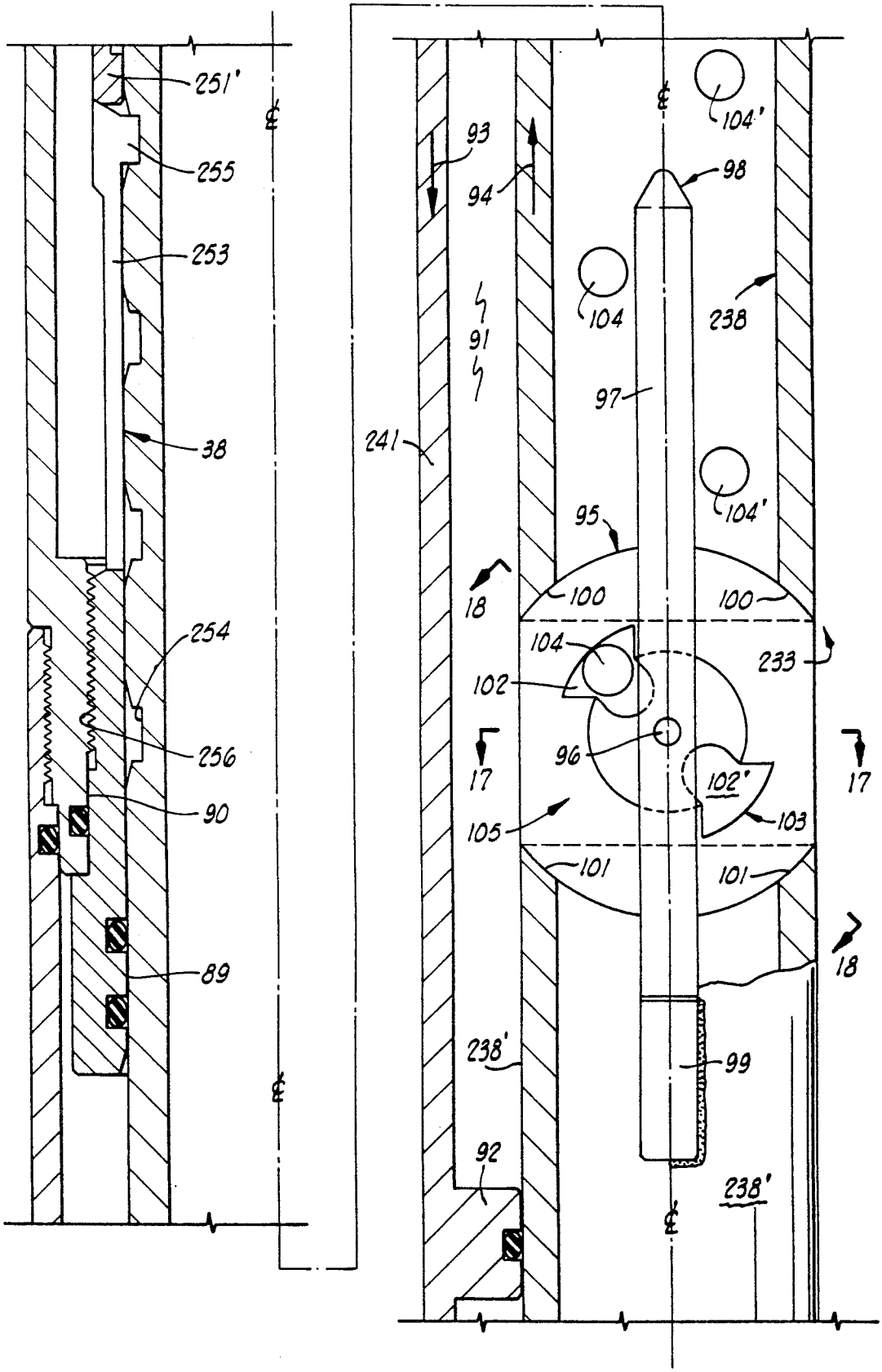
Figure 15:
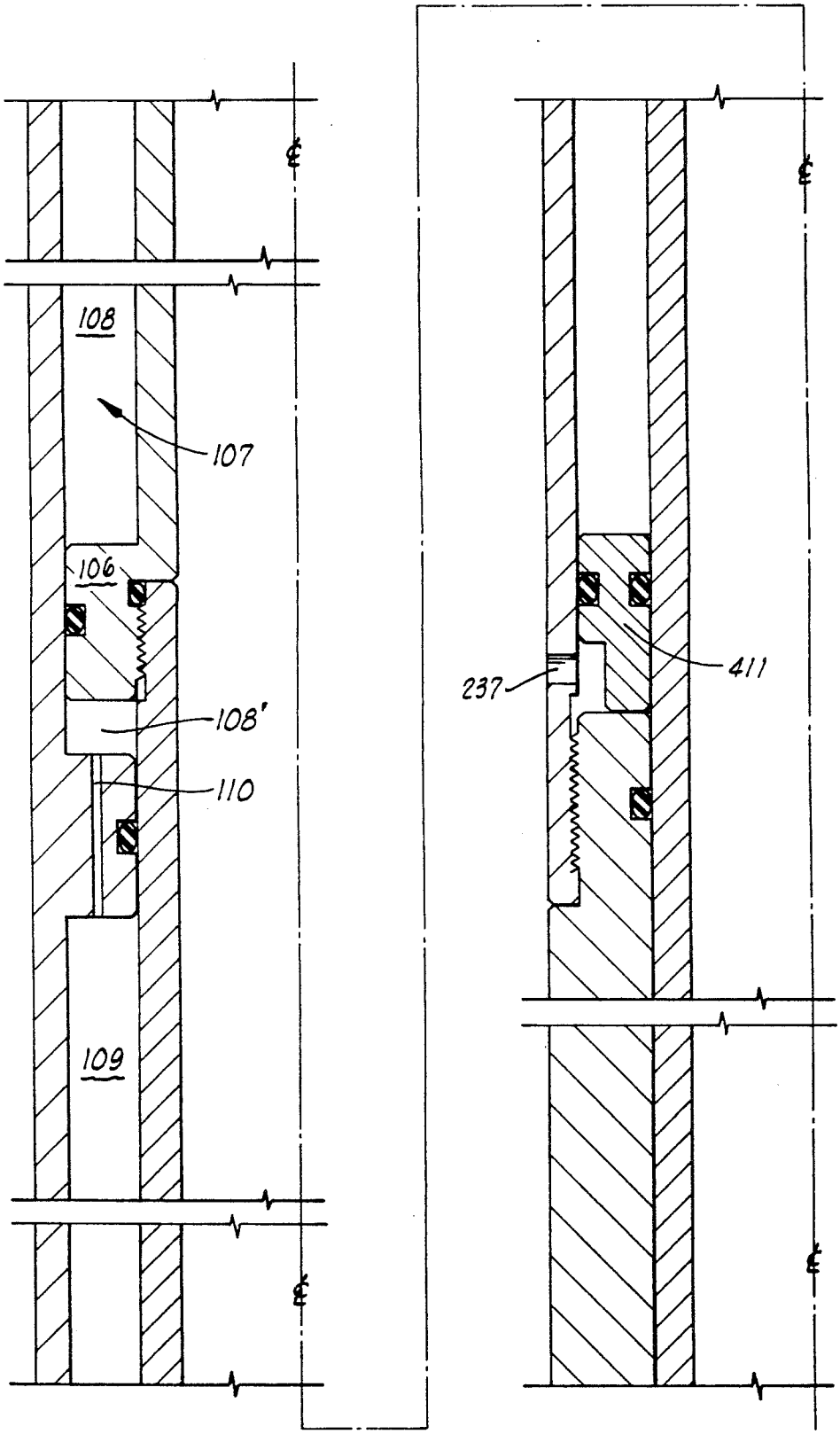
Figure 17:
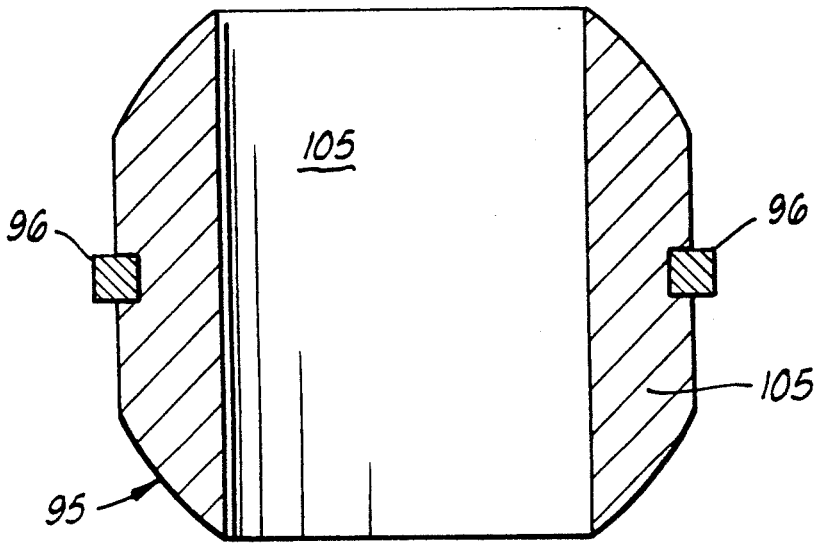
FIGS. 17 and 18 respectfully, are cross-sectional views, taken along lines 17—17 and 18—18, respectively, of FIG. 14.
Figure 18:
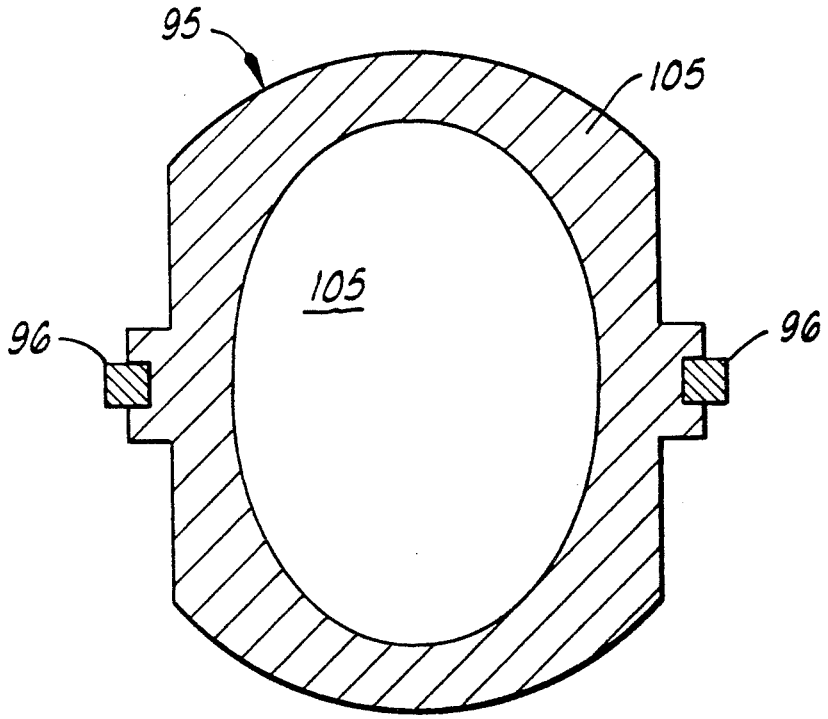

Cavities 102 and 102' are formed 180 degrees apart and along a meridian of the ball valve element 95. The cavities have an entrance 103 within which there is received in a sequential manner one of the pins 104, 104'. The pins 104 are located in aligned relationship along a first row, while the pins 104' are likewise located in a row with the rows defining spaced, parallel lines which are parallel to the central axis of the mandrel. The pins 104, 104', as shown in FIG. 14, can be mounted on mandrel 238.

The ball check valve 95 has a passageway 105 formed therethrough. The lower mandrel part 238' is connected to piston 106 and moves therewith. Piston 106 is reciprocatingly received within chamber 107. Piston 106 and chamber 107 are therefore a power chamber and piston, with the piston 106 dividing the chamber into an atmospheric gas chamber 108 and a liquid chamber 108'. Oil reservoir 109 is connected by means of passageway 110 to the working chamber 108. Floating piston 411 compresses the liquid in chamber 109 in accordance with the magnitude of the upper borehole pressure effected at port 237. Thus, a pressure differential will exist as between the atmospheric chamber 108 and the pressure within the liquid chamber 108'. This differential will cause lower mandrel 238', which is connected to piston 106, to be urged upward into sealing contact with the ball valve element 95 and seal face 100. Further, the upper mandrel part will not begin upward movement because the detentes 254 are co-acting with dog 255 of collet assembly 253.

A packer device can be mounted to the outer surface of the main housing, or alternatively, the apparatus can be provided with a stinger at the lower end thereof for telescopically extending in sealed relationship centrally through a permanent type packer.

OPERATION

The first embodiment 10 of the present invention comprises a novel actuator mechanism located at the upper end thereof; and, as a sub combination of the invention, a novel valve means located at the lower end thereof. The actuator means at the upper end of the valve device can be utilized for actuating either of the novel valve means disclosed herein, as well as other downhole tools.

The apparatus 10 is run downhole on the end of the tubing string, the packer is set, thereby isolating the downhole production zone from the upper borehole annulus and providing a controlled flow path from the payzone to the surface. This can be achieved while drilling the borehole, wherein the valve device 10 is attached to the end of the drill string, or alternatively by incorporating the apparatus in a tool string attached to the end of production tubing or the like.

The valve device is run downhole in the closed configuration. The mandrel is located at its lowest position respective to the main housing. The packer is set, the tool string is tested for leaks, and thereafter a temporary wellhead is employed for achieving a first pressure increase. The magnitude of the first pressure increase must be of a rate and magnitude which exceeds the value required to provide a pressure differential across the release arm actuator piston 46 for driving the piston downhole. This action lifts the fingers of the collet from the detents so that the mandrel is free to move uphole. At the same time the same upper borehole pressure is effected at port 37, thereby driving piston 69 uphole, and compressing the fluid contained within chamber 68, so that the fluid is metered through the jet 67, passageway 66, and into the liquid chamber at the lower end 65 of the power chamber 62. Low pressure gas, such as atmospheric air, resides within chamber 62 while the hydrostatic pressure of the well fluid effected in the upper borehole is indirectly effected at 65. Accordingly piston 63 is urged uphole carrying the mandrel 38 therewith. If the magnitude of this pressure and rate of increase exceeds the designed actuating pressure of the valve device, the power piston 63 will move uphole as soon as the collet fingers have been removed from the detents.

The jets 67 and 47 must be selected to cause the collet fingers to be lifted and then relaxed during an interval of time less than the time interval required for the mandrel to move uphole more than the distance measured between adjacent detents. Accordingly the dog is lifted from the detent, the mandrel commences moving, the dog is relaxed, the face of the dog slides on the outer surface of the mandrel until the next detent arrives under the dog, whereupon the release mechanism becomes reset in the next adjacent detent and the mandrel is firmly fixed to the housing. This action moves the uppermost port 75 into registry with the radial inlet port 76 formed through the housing. Flow can now occur from the payzone, through the aligned ports 75, 76 into the interior of the mandrel, and uphole to the surface of the earth. Flow can continue as long as it is deemed desireable to do so, and when the time arrives for shutting in the well, the sliding valve assembly is moved to the closed position by repeating the previous sequence of operation, hereinafter sometime referred to as one cycle of the tool.

After the well has been shut-in a sufficient length of time to determine the shut-in bottom hole pressure, or whenever it is deemed desireable to do so, the tool can be cycled a second time, whereupon the next adjacent valve port 75 is brought into aligned relationship respective to the housing port 76 by repeating the above pressure increase of the hydrostatic head effected at the area immediately above the packer device. This can be achieved by reducing the pressure at the wellhead for a sufficient length of time for the tool to reach equilibrium, and then again increasing the pressure to the before same magnitude. Alternatively, since the tool is at equilibrium, and the tool strives to always reach equilibrium over a specific time interval, the pressure can be increased another magnitude and at a rate equal to the first increase, whereupon the before described cycle of events will again transpire.

The tool is therefore cycled, causing the mandrel to move respective to the housing a distance equal to the distance measured between the centers of the detents. This distance is equal to one half the distance measured between adjacent ports of the sliding valve so that each mandrel movement alternately moves the valve from a flow to a no-flow configuration and vise versa.

It is essential that the tool of the first embodiment of the invention be run downhole at a slow rate, otherwise the hydrostatic pressure will be effected on the tool at a rate of increase which will actuate or cycle the tool. This is sometime undesirable, and is overcome by the second embodiment of the invention set forth in FIGS. 11–12 of the drawings.

The second embodiment of the invention is similar in operation to the first embodiment of the invention. As seen in FIG. 11, when the liquid contained within chamber 42 is indirectly subjected to increased hydrostatic pressure, flow occurs down the small annulus 42' formed between the lost motion coupling 387 and the mandrel, and into the chamber 45', forcing the release piston 46' in a downhole direction. At the same time, fluid is free to flow through passageway 86, small annulus 85, and into the downhole upper end of the working chamber 45'. A pressure of sufficient magnitude and rate of increase will provide the necessary forces on the opposed sides of the piston for a differential to exist which overcomes friction and the force of spring 49', thereby moving the actuator sleeve 51 downhole, and effecting downhole movement of the collet retraction member, whereupon the ends of the collet fingers are lifted from the detents in the same above described manner. This action frees the mandrel from the housing, and permits relative movement therebetween.

The upper borehole pressure is concurrently effected at the inlet port associated with both the release and the power chamber, as in the before described embodiment. The power chamber causes the power piston to move uphole, carrying the sliding sleeve of the valve means therewith, and thereby aligning or misaligning the coacting flow ports formed in the housing and the mandrel. The operation of the valve device is continued in the above described cyclic manner so that the well can selectively be flowed, shut-in, again flowed and again shut-in for as many times as may be permitted by the number of detents and valve ports provided during the fabrication of the tool.

In the third embodiment of the invention set forth in FIGS. 13–18, the inlet port 19, when subjected to increased hydrostatic pressure within the upper annulus moves piston 243 downhole thereby tending to compress the liquid contained within chamber 242. This creates a pressure in chamber 242 which is substantially equal to the hydrostatic pressure, and thereby moves piston 246 downhole while at the same time a small flow of the liquid commences from chamber 242 into chamber 245.

Movement of piston 246 a small distance downhole actuates the release mechanism at 251' by means of the sleeve 251. The coacting confronting faces found between the collet fingers at 255 and the conical face at 251' lifts the dogs from the groove 254 for a time interval required for the mandrel 238 to commence movement uphole so that when the dog is released, the face of the dog will be riding on the exterior face of the mandrel. As the mandrel continues to move uphole, the dog 255 slides along the mandrel face until it drops into the next adjacent groove, thereby again latching the tool in the next position of operation; i.e. mandrel is fixed respective to housing.

At the same time upper borehole pressure is effected on the liquid contained within chamber 109. This is achieved by means of flow port 237 which is located above the packer and in the upper annulus, which drives the piston 411 uphole so that the liquid contained in chamber 109 is forced through passageway 110 and into the power chamber 108.

Chamber 108 is filled with compressible fluid, as for example atmospheric air. Accordingly the pressure differential across the opposed annular faces of piston 106 drives the piston up hole carrying the mandrel at 238' therewith. The mandrel cannot move unless dog 255 has been released from its associate detent. If the dog has been lifted from the detent, the mandrel 238', ball valve assembly 105, and mandrel part 238 will be moved uphole a distance equivalent to the spaced adjacent centers of the detents.

As the ball valve is moved uphole respective to the housing, the ball is rotated 90 degrees. This action aligns the passageway 105 of the ball with the longitudinal axial centerline of the mandrel. The vertical distance measured between adjacent pins 104, 104' is equal to the distance between adjacent grooves. The pins 104, 104' are received within the entrance 103 of cavity 102 of the ball and thereby impart a rotational force into the ball of a magnitude equal to the force developed by the upthrust of the mandrel, together with the measured distance from the centers of the pins and the pivot point 96 of the ball. The spaced mount means 98 are guideably received between the opposed rows of pins, and maintains alignment between the coacting parts.

It should be noted that when dog 255 is lifted from detent 254, the frictional forces between seat 100 and the ball are reduced, thereby relieving some of the drag between the rotating surface of the ball and the seats.

After the well has flowed a sufficient length of time to determine the reservoir capacity, the well is shut-in by again elevating the pressure within the upper annulus, whereupon the above described events again occur so that the ball is rotated another 90 degrees, and assumes the closed position. After each cycle of operation the valve device will reach equilibrium, regardless of the hydrostatic head, until the hydrostatic head is again changed. The present invention provides a novel means for testing a downhole production zone. The novel apparatus also provides a valve means which can be opened and closed a number of times by utilizing upper annular pressure. The mechanism employed for actuating the valve means can be used for actuating downhole tools other than valves.

While a sliding sleeve valve and a rotating ball valve have been disclosed herein, those skilled in art, having read the foregoing disclosure material, will be able to apply various different novel sub combinations of this invention to other downhole tools, and such a new combination is comprehended by the present claims.

The present invention provides a method by which a downhole tool can be actuated by the employment of linear motion, and also provides a method by which a formation located downhole in a borehole can be tested by utilizing above the packer hydrostatic pressure for controlling the flow from below the packer.

Figure 2:
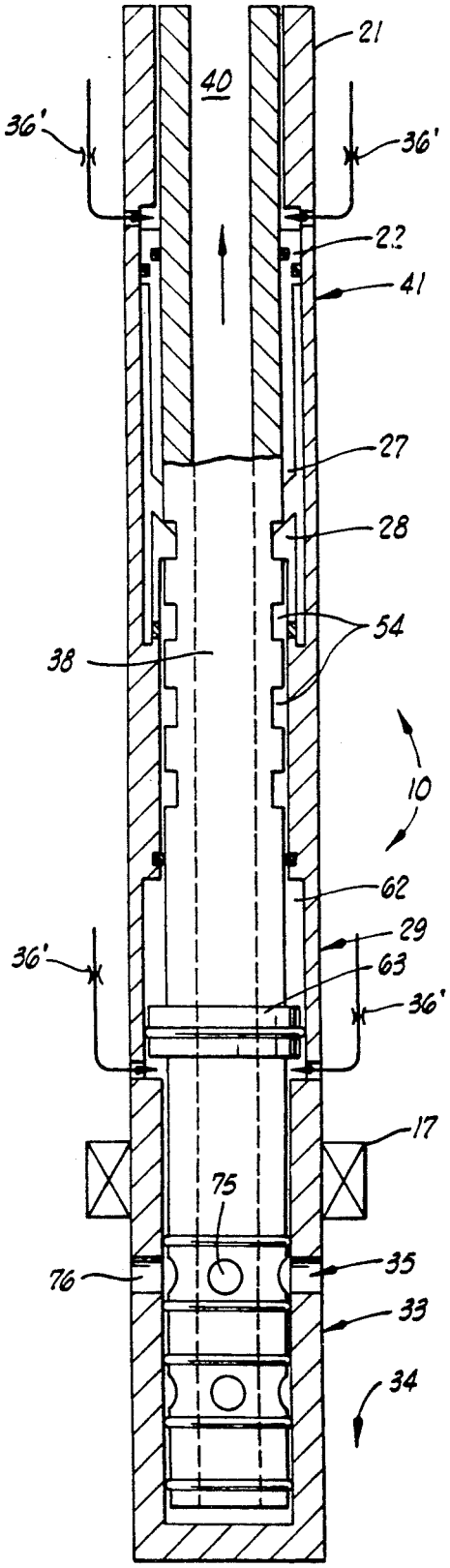
FIG. 2 is an enlarged, diagrammatical, longitudinal, part cross-sectional representation of part of the apparatus disclosed in FIG. 1.

The schematical representation of FIG. 2 sets forth some of the important operational features of the present invention. In FIG. 2 the valve device 10 is sealingly received through the axial bore of a packer 17. The packer 17 can be positioned most anywhere along the length of the valve device so long as the chamber of metering piston 25 and power piston 62 is flow connected through an orifice means 36' that senses the pressure of the upper annulus. It is desirable that the formation fluid inlet 76, formed through the housing 41 of the tool, be located near the payzone to thereby establish a direct flow path from the formation, into the inlet of the valve device, and to the surface of the ground.

A latch means 28 is mounted to the housing 41. The latch means engages spaced detents or grooves 54 formed in the mandrel. The mandrel is normally latched to the housing and cannot be reciprocated respective to the housing so long as the latch means 28 engages one of the grooves 54. The mandrel is moved uphole in response to movement of a power piston 63. The power piston moves in response to metered pressure effected within chamber 62 along a metered flow path 36.

A hydraulically actuated unlatching mechanism 22, 27 retracts the latch means and permits the mandrel 38 to move uphole a distance equal to the interval measured between adjacent grooves 54. Movement of piston 22 actuates the unlatching device. The valve means is moved between alternant positions (flow,no-flow) each movement uphole of the mandrel. It is therefore necessary that the latch means be retracted to enable the power piston 63 to move the mandrel uphole a sufficient distance to move the valve means to the alternant flow position. This enables the valve means to be moved from the closed to the opened position, or vice versa, so that flow can occur from the formation into the tool, and uphole for any length of time desired; thereafter the latch means is again retracted and the valve means is moved to the closed position where it remains closed for any desired time interval, and thereafter the valve may again be moved to the opened position, with this sequence of events continuing as many times as may be deemed desirable subject to the number of cycles which has previously been built into the tool.

Figure 19:
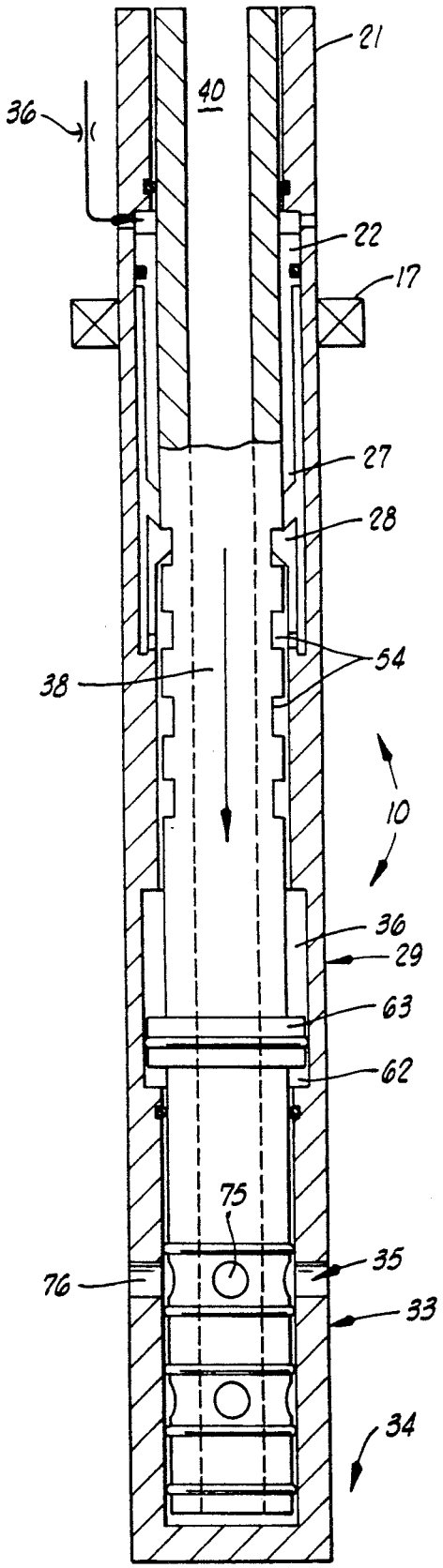
FIGS. 19 and 20 each illustrate a diagrammatical, longitudinal, cross-sectional view of another form of the invention.

In the alternate form of the invention set forth in the diagrammatical representation of FIG. 19, the power chamber 62 and power piston 63 are located below packer 17. Upper annulus fluid is effected through the upper ports 36 through a metering device, and provides a force for moving unlatching piston 22 downhole where the latch 28 is retracted from the mandrel. At the same time, fluid flows from the port at 36, thereby forcing power piston 63 downhole, carrying mandrel 38 therewith. The mandrel in FIG. 19 has been moved to the lowermost position respective to the main outer housing.

Figure 20:
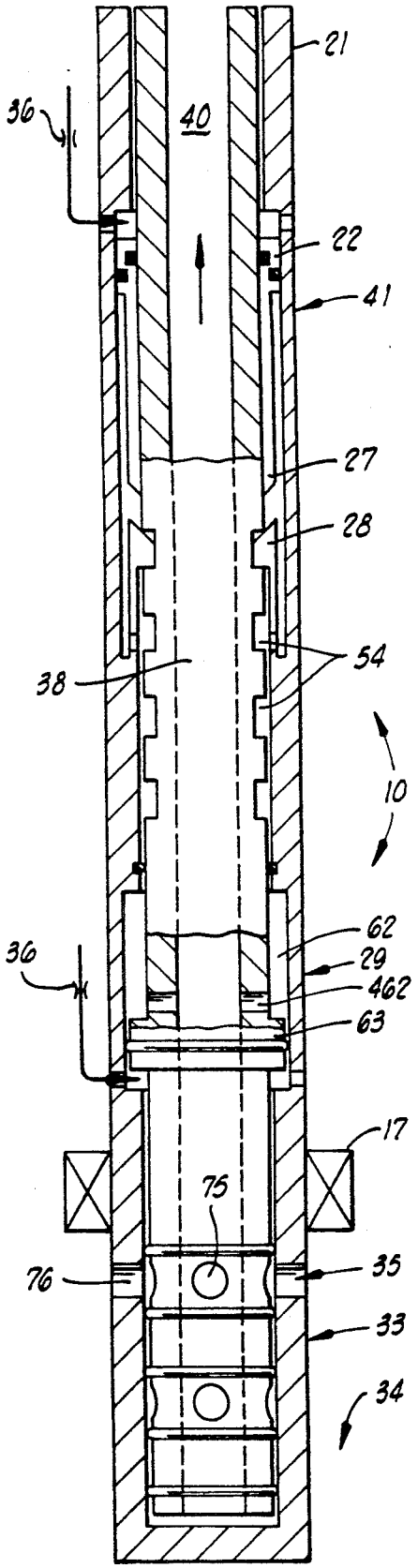

In the alternate form of the invention set forth in the diagrammatical representation of FIG. 20, the chamber 62 communicates with passageway 40 of mandrel 38 by means of flow ports 462. Chamber 62 is isolated from the latch chamber by the illustrated seals and fluid contained within the chamber 62 is free to be exchanged with the passageway 40 by means of ports 462. The other embodiments of the invention can be modified by the provision of ports 462 in the manner of FIG. 20.

Figure 22:
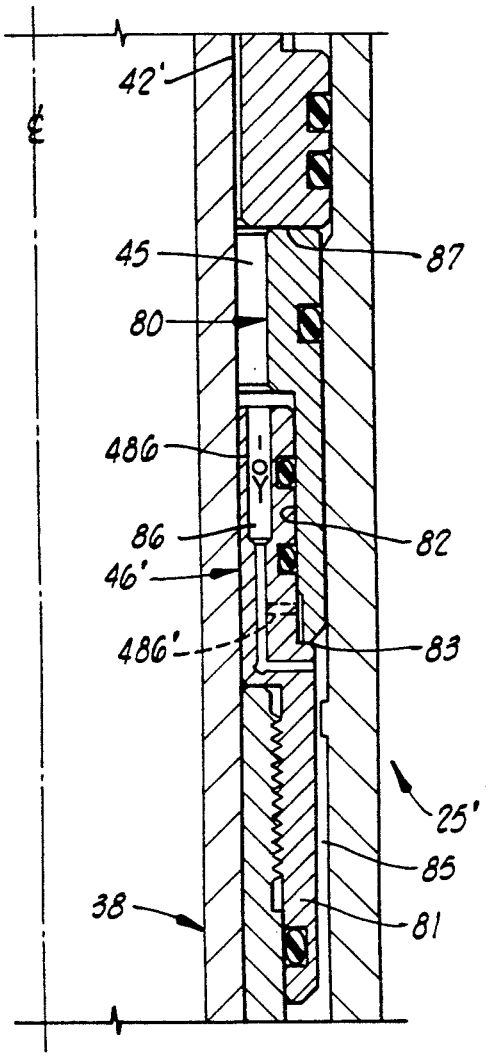
FIG. 22 is a view of the Lee Check Valve as seen in FIG. 11.
Figure 21:
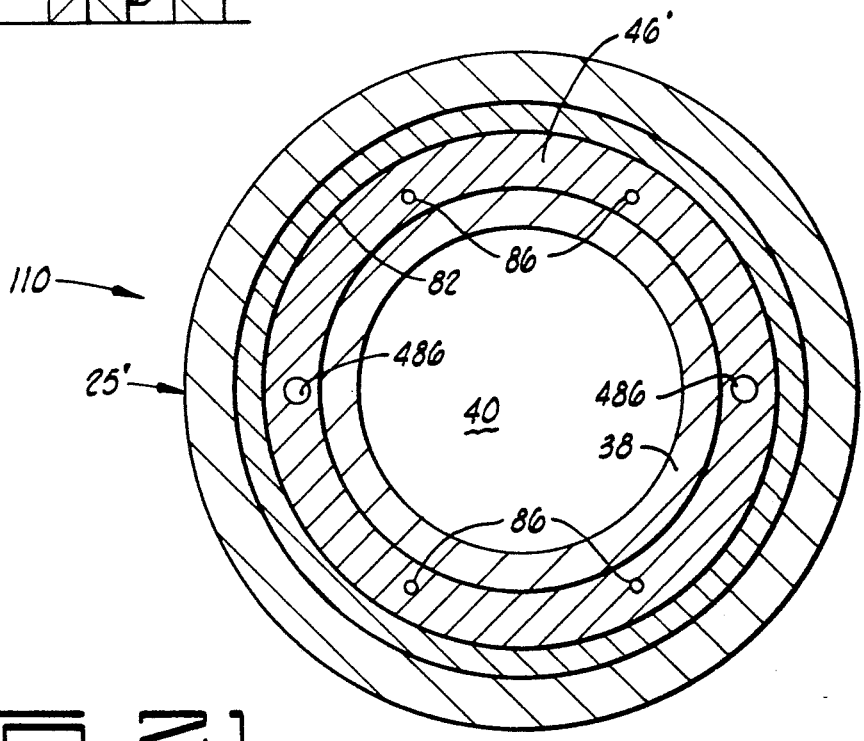
FIG. 21 is a cross-sectional view taken along line B—B of FIG. 11.

In FIG. 22, a plurality of free flow reverse Lee Check Valve (TM) are circumferentially arranged about member 81 of actuator piston 46' for permitting flow downhole through the entire valve assembly and thereby permits flow from the lower chamber 45' through passageways 486, and into upper chamber 45', while the alternate passageway 86 permits flow therethrough only when members 80 and 81 are parted, which moves lip seal valve 83 into the flow position. Hence, member 81 of the complex two piece piston 46' is provided with a circle of passageways 86 which are closed by lip seal 83, and a circle of passageways 486 having Lee Check Valves therein which lead to annulus 85 and bypass or circumvent the lip seal. Further, shoulder 87, when the tool is running into the hole, is telescoped into the alternate position wherein confronting shoulders A-B of FIG. 11 abuttingly engage one another. The displacement of shoulder 87 uphole into the running in configuration enables piston 46' to follow shoulder 87 into the enlarged chamber, and thereby equalizes the pressure across the entire piston.

In the alternate embodiments of the invention, other than the valve actuator of FIG. 11, it is necessary that the rate at which the pressure is applied to the actuating piston occur within a time interval wherein the pressure differential across the piston is established prior to equalization through the Lee Check Valve or metering orifice in the piston. That is, the piston, when the appropriate pressure differential is applied thereto, will commence to move, but, at the same time, the metering passageway through the piston commences to equalize the pressure across the piston, and accordingly the former action must be completed prior to the later.

The packer sub of FIG. 8 is of a design dependent upon the manufacture thereof and accordingly it is advantageous to be able to compensate for packers of various lengths. This is accomplished by the coacting threaded connection formed between the lower marginal end 38' of the mandrel and the sliding guide 74' seen illustrated in FIG. 9.

In FIG. 9, the mandrel 38 often has a very thin wall section which cannot be properly threaded. This disadvantage is surmounted by the provision of a collet arrangement seen at 73 of FIG. 9. The collet fingers along with the lower end of the mandrel is telescoped through the packer and is stabbed into the female part of the collet 73. Then the lower marginal end 38' is rotated respective to the upper marginal end of the mandrel until the apparatus assumes the configuration seen in FIG. 9. This arrangement enables the actuator to be connected in proper indexed relationship respective to the valve means.

We claim:

1. Well control apparatus including a valve device with an upper and lower marginal end connected to an elongated tubing means and positioned downhole in a borehole for conducting fluid flow from a lower part of the borehole to the surface of the ground, a packer device associated with the valve device which divides the borehole into an upper and a lower annulus, means placing the upper marginal end of the valve device in communication with the upper borehole annulus and the lower marginal end of the valve device is in communication with the lower borehole annulus;

said valve device including an outer annular housing, an annular mandrel slidably received within said housing, at least one mandrel port formed through the sidewall of the lower marginal end of the mandrel, at least one port formed through the sidewall of the lower marginal end of the housing, seal means by which the lower marginal end of the mandrel sealingly and slidably cooperate with the lower marginal end of the housing such that when a mandrel port is brought into registry with a housing port, a flow path is established from the lower annulus and through the aligned ports into the mandrel; and, when the mandrel port is slidably moved and positioned with the ports being misaligned respective to one another, flow from the lower annulus into the mandrel is precluded;

a power chamber formed between the mandrel and the housing, a power piston attached to said mandrel and slidably received within said power chamber, said piston dividing said power chamber into upper and lower variable chambers;

means for effecting the upper annulus pressure within said upper variable chamber;

latch means by which said mandrel is latched into a plurality of different vertically spaced latch positions as the mandrel is moved respective to the housing, pressure responsive means by which said latch means is released when the upper annulus pressure is increased to a first magnitude of pressure;

said latch positions being spaced apart an amount whereby when the mandrel is forced downhole a first distance in response to a first pressure increase, the sliding valve assembly moves to an opened position, and when said mandrel is moved downhole a second distance in response to a second pressure increase, the sliding valve assembly moves to a closed position.

2. A wellbore apparatus responsive to changes in well annulus pressure, said apparatus including a well annulus packer for isolating the well annulus from a formation fluid, said apparatus comprising:

a cylindrical housing containing a shoulder, said cylindrical housing having a first portion defining a first and second port, and said cylindrical housing having a second portion defining a plurality of apertures;

an operating mandrel with a first and second end, said operating mandrel being slidingly, releasably disposed within said cylindrical housing, said operating mandrel containing on the first end:

a portion defining a plurality of detents, a power piston sub being attached to said operating mandrel, said operating mandrel with said power piston sub and said cylindrical housing forming a first and second chamber; and a plurality of apertures formed at the second end of said operating mandrel;

means for anchoring said operating mandrel relative to said cylindrical housing so that the apertures of said operating mandrel are not aligned with the aperture of said cylindrical housing;

means for moving said power piston sub longitudinally upward so that the apertures of said operating mandrel are aligned with the apertures of cylindrical housing;

a disengaging sleeve disposed about said operating mandrel and slidably mounted within said cylindrical housing, said disengaging sleeve containing a first end and a second end, the first end containing a metering bore with a shoulder and the second end containing a frusto-conical shoulder which cooperates with said anchoring means;

means for axially urging said disengaging sleeve downward in order to contact said anchoring means; and means for biasing said disengaging sleeve upward so that said disengaging sleeve is no longer contacting said anchoring means.

3. The apparatus of claim 2, wherein said first portion defining the first and second port on said cylindrical housing is disposed above the well annulus packer, and the second portion defining a plurality of apertures on said cylindrical housing is disposed below the well annulus packer.

4. The apparatus of claim 3, wherein said means for anchoring said operating mandrel relative to said cylindrical housing comprises:

a plurality of collet fingers containing a first end and a second end, the first end containing a shoulder which engages the detents and the second end being securely attached to said cylindrical housing.

5. The apparatus of claim 4, wherein said means for moving said power piston sub longitudinally upward comprises:

a floating piston adjacent to the second port of said cylindrical housing, said floating piston being disposed within the second chamber and being responsive to well annulus pressure, and said floating piston in said second chamber forming relative to said cylindrical housing and said operating mandrel a first half chamber and second half chamber of said second chamber, the second half chamber containing a compressible liquid; and a metering orifice containing an inlet and outlet being disposed within said cylindrical housing, said metering orifice inlet being adjacent to said second half chamber of said second chamber so that compressible liquid in said second half chamber of said second chamber is transmitted therethrough, said metering orifice outlet forming a passageway in order to transmit said compressible liquid.

6. The apparatus of claim 4, wherein said means of axially urging said disengaging sleeve downward comprises:

a free piston adjacent to said first port slidably disposed about said operating mandrel, said free piston and said operating mandrel forming a third and fourth chamber;

means for biasing said free piston within the fourth chamber;

a compressible liquid placed in said fourth chamber so that as well annulus pressure is increased, said free piston acts against the biasing means and transmits increase fluid pressure to said compressible liquid in said fourth chamber; and wherein said cylindrical housing and operating mandrel form a passageway with an inlet and outlet, said passageway being adjacent to said fourth chamber so that as pressure in the fourth chamber is increased, the fluid is transmitted to the outlet of said passageway and flows through said metering bore of said disengaging sleeve.

7. The apparatus of claim 4, wherein said means for biasing said disengaging sleeve upward comprises:

a helical spring with a first end and second end, said spring being disposed about said disengaging sleeve; and wherein the first end of said helical spring abuts the shoulder of the metering bore of said disengaging sleeve, and the second end of said spring abuts the shoulder of said cylindrical housing, so that a hydrostatic pressure is increased and transmitted thru said first port, said spring is in compression, which allows the disengaging sleeve to move downward and as hydrostatic pressure is released, the spring expands and moves said disengaging sleeve axially upward so that the disengaging sleeve no longer contacts said collet fingers.

8. The apparatus of claim 5, wherein said compressible liquid is silicone oil.

9. The apparatus of claim 6, wherein said compressible liquid is silicone oil.

* * * * *